US012660870B2

(12) United States Patent
Farr et al.

(10) Patent No.: US 12,660,870 B2
(45) Date of Patent: Jun. 23, 2026

(54) GLOVES INCLUDING BLADDER COMPONENTS

(71) Applicant: NIKE, Inc., Beaverton, OR (US)

(72) Inventors: Isaac Farr, Beaverton, OR (US); George S. Kim, Wilsonville, OR (US); Oliver McLachlan, Beaverton, OR (US); Levi J. Patton, Portland, OR (US); Christian Alexander Steinbeck, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/932,141

(22) Filed: Oct. 30, 2024

(65) Prior Publication Data

US 2026/0114524 A1 Apr. 30, 2026

(51) Int. Cl.
*A41D 19/015* (2006.01)
*A41D 31/04* (2019.01)

(52) U.S. Cl.
CPC ..... *A41D 19/015* (2013.01); *A41D 31/04* (2019.02)

(58) Field of Classification Search
CPC ..... A41D 19/01523; A41D 19/015; A41D 31/04; A63B 71/14; A63B 71/141;
(Continued)

(56) References Cited

U.S. PATENT DOCUMENTS 2,275,206 A 3/1942 Sutherland
2,842,771 A 7/1958 Foti
(Continued)

FOREIGN PATENT DOCUMENTS

WO 9211780 A1 7/1992
WO 9628056 A1 9/1996
(Continued)

OTHER PUBLICATIONS

"Weldas COMFOflex Air Cushioned—Split Leather Premium Welding Gloves", Amazon, amazon.com, ASIN: B0792LWNYS Date First Available: Jan. 16, 2018, https://www.amazon.com/Weldas-COMFOflex-Air-Cushioned-Leather/dp/B0792LWNYS.
(Continued)

*Primary Examiner* — Katherine M Moran
(74) *Attorney, Agent, or Firm* — Banner & Witcoff, Ltd.

(57) ABSTRACT

Bladder components and gloves that include such bladder components attenuate impact forces incident on the glove and/or a wearer's hand. Such bladder components and gloves may dampen impact forces applied by a game ball or other projectile to the glove (and thus to the wearer's hand) and/or reduce the energy returned to the game ball or other projectile from the glove. These features may better enable ball control (e.g., by limiting the ball's rebound force/distance off the hand) and/or improve wearer's comfort. Further, such gloves may provide delayed re-expansion of the bladder chamber and/or foam material to keep the bladder chamber and/or foam in a compressed configuration as the wearer grasps the ball/projectile from the glove during further play. In this manner, the ball will remain positioned in the glove at an expected location so that the wearer can easily locate and grasp the ball/projectile.

20 Claims, 7 Drawing Sheets

(58) Field of Classification Search
CPC ... A63B 71/143; A63B 71/144; A63B 71/146; A63B 71/148; A63B 71/16
See application file for complete search history.

(56) References Cited

U.S. PATENT DOCUMENTS

| | | | | | |
|---|---|---|---|---|---|
| 2,881,445 | A | | 4/1959 | Vrana | |
| 3,008,214 | A | | 11/1961 | Foster et al. | |
| 3,640,831 | A | * | 2/1972 | Gardner | A63B 71/081 428/72 |
| 4,168,063 | A | | 9/1979 | Rowland | |
| 4,183,156 | A | | 1/1980 | Rudy | |
| 4,262,046 | A | * | 4/1981 | Eitel | B32B 27/08 428/79 |
| 5,113,530 | A | * | 5/1992 | Smith | A63B 71/143 D29/115 |
| 5,121,962 | A | * | 6/1992 | Weber | A41D 19/01523 297/214 |
| 5,155,864 | A | | 10/1992 | Walker et al. | |
| 5,155,865 | A | | 10/1992 | Walker et al. | |
| 5,218,719 | A | | 6/1993 | Johnson | |
| 5,274,846 | A | * | 1/1994 | Kolsky | F16F 1/3737 428/313.5 |
| 5,309,573 | A | | 5/1994 | Solar et al. | |
| 5,345,609 | A | * | 9/1994 | Fabry | A41D 19/01523 2/161.1 |
| 5,423,088 | A | | 6/1995 | Walker et al. | |
| 5,427,577 | A | | 6/1995 | Picchietti et al. | |
| 5,537,688 | A | * | 7/1996 | Reynolds | A41D 19/01523 2/904 |
| 5,603,118 | A | * | 2/1997 | Solomon | A41D 19/01523 2/163 |
| 5,771,490 | A | * | 6/1998 | Reynolds | F16F 9/0472 74/551.9 |
| 6,014,823 | A | | 1/2000 | Lakic | |
| 6,065,150 | A | * | 5/2000 | Huang | A41D 19/01523 2/161.1 |
| 6,202,213 | B1 | | 3/2001 | Georgick | |
| 6,308,331 | B1 | | 10/2001 | Robak | |
| 6,430,751 | B1 | | 8/2002 | Tourbier et al. | |
| 7,103,919 | B2 | * | 9/2006 | Isom | A41D 19/01535 2/160 |
| 8,220,071 | B2 | * | 7/2012 | Rhoades | A63B 71/143 2/161.1 |
| 8,656,513 | B2 | | 2/2014 | Plocher | |
| 8,671,463 | B2 | * | 3/2014 | Hawkes | A41D 19/01523 2/161.6 |
| 12,104,673 | B2 | * | 10/2024 | Schuller | A41D 13/015 |
| 2008/0244801 | A1 | | 10/2008 | Russo | |
| 2009/0158496 | A1 | | 6/2009 | Roeckl | |
| 2014/0245527 | A1 | | 9/2014 | Douglas et al. | |
| 2018/0332924 | A1 | | 11/2018 | Bailey et al. | |
| 2020/0306591 | A1 | | 10/2020 | Billeaudeaux et al. | |
| 2022/0400792 | A1 | * | 12/2022 | Kim | A63B 71/081 |

FOREIGN PATENT DOCUMENTS

| | | | | | |
|---|---|---|---|---|---|
| WO | 9720478 | A1 | | 6/1997 | |
| WO | 9828055 | A1 | | 7/1998 | |
| WO | 9966810 | A1 | | 12/1999 | |
| WO | 2008009945 | A1 | | 1/2008 | |
| WO | WO-2017075671 | A1 | * | 5/2017 | A63B 71/145 |

OTHER PUBLICATIONS

Banzai Kids Inflatable Mega Boxing Gloves, Red Blue, Amazon, amazon.com, ASIN: B00WORTWGA, Release date: Mar. 1, 2018, https://www.amazon.com/Banzai-Kids-Inflatable-Boxing-Gloves/dp/B00WORTWGA.

* cited by examiner

GLOVES INCLUDING BLADDER COMPONENTS

FIELD OF THE INVENTION

The present technology relates to bladder components and gloves (e.g., sports gloves) and other hand-receiving devices that include such bladder components. Bladder components, gloves, and/or other hand-receiving devices including the bladder components may be used, for example, for attenuating impact forces incident on the bladder, gloves, and/or other hand-receiving devices (e.g., from a game projectile) and/or dampening return energy (e.g., energy returned to a projectile after contact with the bladder, glove, or other hand-receiving device). In some aspects of this technology, these features may better enable projectile control (e.g., by limiting the projectile's rebound force/distance off the bladder/glove/hand-receiving device) and/or improve wearer's comfort. Additionally or alternatively, in some aspects of this technology, the bladder's re-expansion rate will be tuned and controlled to delay or slow re-expansion. Additional aspects of this technology relate to methods of making and using such bladder components, gloves, and/or other hand-receiving devices.

At least some aspects of this technology may relate to and/or be used in conjunction with the technology disclosed in: (a) U.S. patent application Ser. No. 17/844,957 filed Jun. 21, 2022 and entitled "Gloves and/or Other Hand-Receiving Devices with Inflatable Components;" (b) U.S. Provisional Patent Appln. No. 63/212,946 filed Jun. 21, 2022 and entitled "Gloves and/or Other Hand-Receiving Devices with Inflatable Components;" (c) U.S. Provisional Patent Appln. No. 63/611,972 filed Dec. 19, 2023 and entitled "Impact Force Attenuating Bladder Components Having Controlled Re-Expansion Rates and Methods of Making and using Such Components;" and/or (d) a concurrently filed U.S. Non-Provisional Patent Application entitled "Protective Equipment Including Bladder Components". Each of U.S. patent application Ser. No. 17/844,957, U.S. Provisional Patent Appln. No. 63/212,946, U.S. Provisional Patent Appln. No. 63/611,972, and the concurrently filed Non-Provisional Patent Application identified above is entirely incorporated herein by reference.

BACKGROUND

Several sports include use of game balls or other projectiles (e.g., hockey pucks) that may come into contact with the players during play of the game. In many sports, one or more players will be tasked with catching or deflecting the game ball or other projectile during play (e.g., goalies for soccer, hockey, field hockey, lacrosse, etc.; baseball and softball players; football players; etc.). Many players wear sports gloves to help protect the hands during interactions with the game ball or other projectile.

SUMMARY

This Summary is provided to introduce some general concepts relating to this technology in a simplified form that are further described below in the Detailed Description. This Summary is not intended to identify key features or essential features of the invention.

Aspects of this technology relate to bladder components, gloves (e.g., sports gloves), and/or other hand-receiving devices that include such bladder components. The bladder components attenuate impact forces incident on the glove/device and/or the wearer's hand. Such bladder components and gloves/devices may dampen impact forces applied by a game ball or other projectile to the glove/device (and thus to the wearer's hand) and reduce the energy returned to the game ball or other projectile from the bladder component and glove/device. These features may better enable ball/projectile control (e.g., by limiting the ball/projectile's rebound force/distance off the hand) and/or improve wearer's comfort. Further, controlled and delayed re-expansion of the bladder (e.g., using force applied by a foam material and/or other resilient component within the bladder) may keep the bladder (e.g., the foam material and/or other resilient component) in a compressed configuration, e.g., as the wearer grasps the ball/projectile in further play. In this manner, the ball/projectile will remain stably positioned within the glove/device in a time period immediately after contact.

Additional or alternative aspects of this technology relate to bladders that include: (A) a thermoplastic envelope (e.g., formed from two (or more) thermoplastic layers or sheets that are sealed together at a seam) defining an interior chamber that is movable between an expanded configuration and a compressed configuration, wherein one or more through hole openings are defined through the thermoplastic envelope (e.g., through one or both thermoplastic layers or sheets), the one or more through hole openings permitting fluid from an external environmental area to enter the interior chamber, and wherein the interior chamber of the bladder defines a thumb chamber portion and a first finger chamber portion; (B) at least a first fluid line in fluid communication with the interior chamber and with the external environmental area, wherein the first fluid line is separate from the one or more through hole openings; (C) at least a first valve located and configured with respect to the first fluid line to allow fluid to exit the interior chamber via the first fluid line but inhibiting fluid from the external environmental area from entering the interior chamber via the first fluid line; and (D) a resilient component (e.g., a foam material) located in the interior chamber, the resilient component applying a force to the thermoplastic envelope in a direction toward the expanded configuration. If desired, a single bladder may include two or more fluid line and valve combinations. The bladder may be included as part of a glove (e.g., a sports glove) or other hand-receiving device.

Additional or alternative aspects of this technology relate to bladders that include: (A) a thermoplastic envelope (e.g., formed from two (or more) thermoplastic layers or sheets that are sealed together at a seam) defining an interior chamber that is movable between an expanded configuration and a compressed configuration, wherein one or more through hole openings are defined through the thermoplastic envelope (e.g., through one or both thermoplastic layers or sheets), the one or more through hole openings permitting fluid from an external environmental area to enter the interior chamber, and wherein the interior chamber of the bladder defines a base chamber region and a first finger chamber portion extending from the base chamber region; (B) a first fluid line in fluid communication with the interior chamber and with the external environmental area, wherein the first fluid line is separate from the one or more through hole openings; (C) a first valve located and configured with respect to the first fluid line to allow fluid to exit the interior chamber via the first fluid line but inhibiting fluid from the external environmental area from entering the interior chamber via the first fluid line; and (D) a resilient component (e.g., a foam material) located in the interior chamber, the resilient component applying a force to the thermoplastic envelope in a direction toward the expanded configuration. If desired, a single bladder may include two or more fluid line and valve combinations. The bladder may be included as part of a glove (e.g., a sport glove) or other hand-receiving device.

Additional or alternative aspects of this technology relate to gloves (e.g., sport gloves) or other hand-receiving devices that include a base member (e.g., a glove base member) and a bladder engaged with the base member (e.g., with an outer surface of the base member). The bladder may include: (A) a thermoplastic envelope (e.g., formed from two (or more) thermoplastic layers or sheets that are sealed together at a seam) defining an interior chamber that is movable between an expanded configuration and a compressed configuration, wherein one or more through hole openings are defined through the thermoplastic envelope (e.g., through one or both thermoplastic layers or sheets), the one or more through hole openings permitting fluid from an external environmental area to enter the interior chamber; (B) a first fluid line in fluid communication with the interior chamber and with the external environmental area, wherein the first fluid line is separate from the one or more through hole openings; (C) a first valve located and configured with respect to the first fluid line to allow fluid to exit the interior chamber via the first fluid line but inhibiting fluid from the external environmental area from entering the interior chamber via the first fluid line; and (D) a resilient component (e.g., a foam material) located in the interior chamber, the resilient component applying a force to the thermoplastic envelope in a direction toward the expanded configuration. If desired, the bladder may include two or more fluid line and valve combinations.

In use, a game ball or other projectile (e.g., a soccer ball, baseball, softball, football, lacrosse ball, hockey puck, etc.) contacts a glove or other hand-receiving device, wherein the game projectile contacts the glove or other hand-receiving device at a location to apply incident force to a surface of a bladder included with the glove or other hand-receiving device (e.g., the bladder being of the types described above). This contact causes: (i) the foam material and/or other resilient component in the bladder to change from an expanded configuration to a compressed configuration and (ii) fluid (e.g., air) to exit the interior chamber through the fluid line(s) and the valve(s). Fluid is admitted into the interior chamber of the bladder through the one or more through hole openings, but the through hole opening(s) is/are sized to delay and control expansion of the foam material and/or other resilient component back to its expanded configuration. In this manner: (a) rebound forces applied to the ball/projectile are reduced, helping assure that the ball/projectile remains close to the player that contacted it and/or (b) impact forces applied to the wearer's hand are reduced. Further, delayed re-expansion of the foam material and/or other resilient component may keep the foam material and/or other resilient component in a compressed configuration as the wearer continues play immediately after initially contacting the ball/projectile.

Still additional aspects of this technology relate to gloves (e.g., sports gloves) and/or other hand-receiving devices including such bladders and/or to methods of making and/or using the bladders, gloves, and/or hand-receiving devices, e.g., of the types described above.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1A:
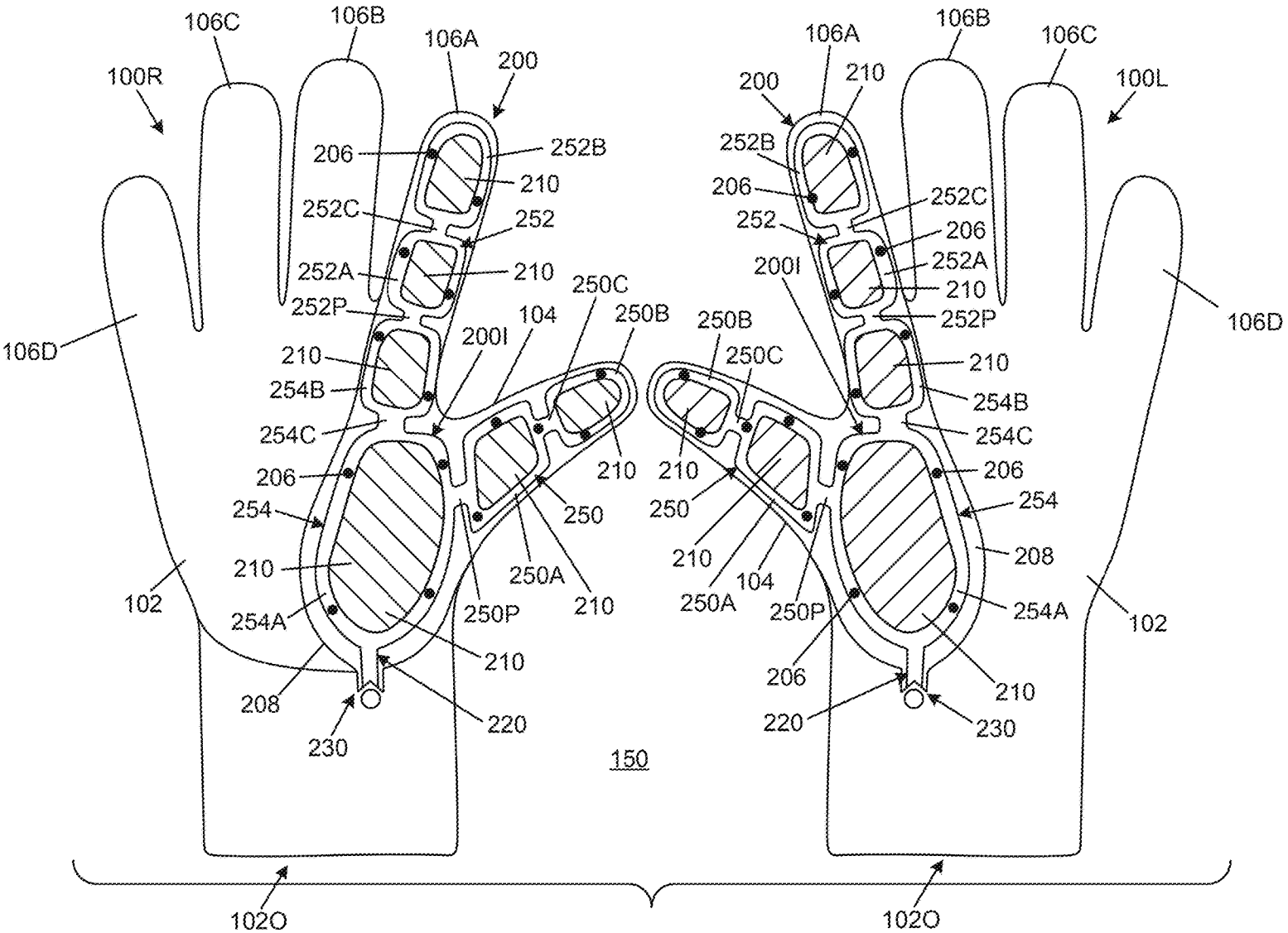
FIGS. 1A-1E illustrate bladders, gloves, and their use in accordance with some examples of this technology.

In the following description of various examples of glove structures and components according to the present technology, reference is made to the accompanying drawings, which form a part hereof, and in which are shown by way of illustration various example structures and environments in which aspects of the present technology may be practiced. It is to be understood that other structures and environments may be utilized and that structural and functional modifications may be made to the specifically described structures and methods without departing from the scope of the present disclosure.

"Glove," as that term is used herein means a covering for at least a portion of a hand (e.g., covering at least a portion of one or more of the palm, the thumb, the rear, and/or at least one finger of a wearer's hand). "Gloves" may include separate sections, e.g., one section for receiving the thumb and at least one section for receiving one or more fingers. Unless otherwise noted, the term "glove" as used herein includes structures that may be considered "mitten" type structures (where two or more fingers are received in a single section and/or extend through a single channel) and/or "fingerless gloves" (i.e., glove structures in which one or more of the thumb or fingers sticks out an open end of the digit receiving opening or compartment). "Gloves" also include all types of sports gloves, such as baseball gloves, softball gloves, batting gloves, cricket gloves, golf gloves, America football gloves, weightlifting gloves, exercise gloves, goalkeeper gloves (e.g., for soccer, hockey, field hockey, lacrosse, etc.), etc. "Hand-receiving devices," as that term is used herein, includes within its scope all types of gloves plus any other device that a user wears and contains at least a portion of a wearer's hand, such as controllers for video games, braces, etc.

This application and/or its claims may use the terms, e.g., "first," "second," "third," and the like, to identify certain components and/or features relating to this technology. These terms are used merely for convenience, e.g., to assist in maintaining a distinction between components and/or features of a specific structure. Use of these terms should not be construed as requiring a specific order or arrangement of the components and/or features being discussed. Also, use of these specific terms in the specification for a specific structure does not require that the same term be used in the claims to refer to the same structure (e.g., a component or feature referred to as the "third" in the specification may correspond to any numerical adjective used for that component or feature in the claims).

The term "resilient" as used herein, unless otherwise noted or clear from the context, refers to a property of a component (e.g., a material or a structure) that enables the component to recoil, spring, or return back to its original size and/or shape after bending, stretching, or being compressed. "Resilient" components may include materials, such as open cell foams, closed cell foams, elastomers, and the like and/or may include structures or components, such as blocks of material including resilient materials, springs, mechanical shock absorbing elements, etc.

Also, while some of the appended figures illustrate features of gloves and components for one of a wearer's hands, those skilled in the art, given benefit of this disclosure, will understand that this technology can be applied to gloves and components for the other hand as well (e.g., as mirror images from the structures illustrated in the appended drawings). Also, while the detailed discussion below refers primarily to "gloves," the same discussion may be used with and applied to other hand-receiving devices. Those skilled in the art, given benefit of this disclosure, will understand that this technology can be applied to other hand-receiving devices in the same or similar manner.

Given the general description of features, aspects, structures, and arrangements according to certain examples of this technology provided above, a more detailed description of specific example bladders, gloves, and methods in accordance with this technology follows. Where the same reference number appears in multiple figures, the same or similar part is being referenced (including any applicable options or alternatives for that part), and at least some of the overlapping description of that part may be omitted.

Figure 1B:
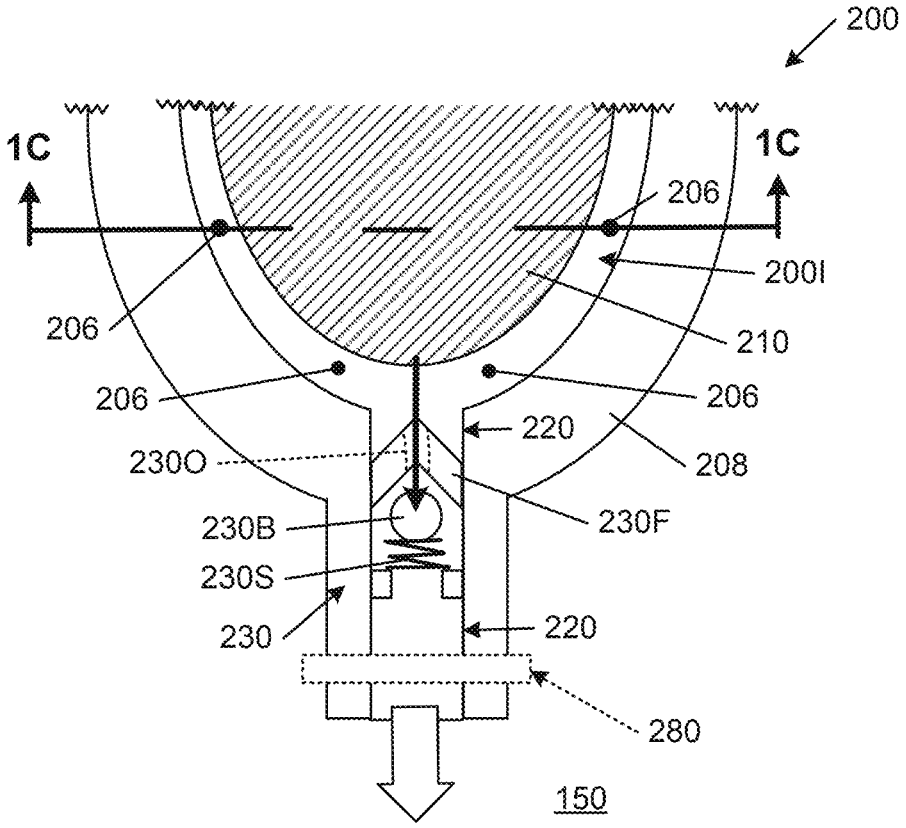
Figure 1C:
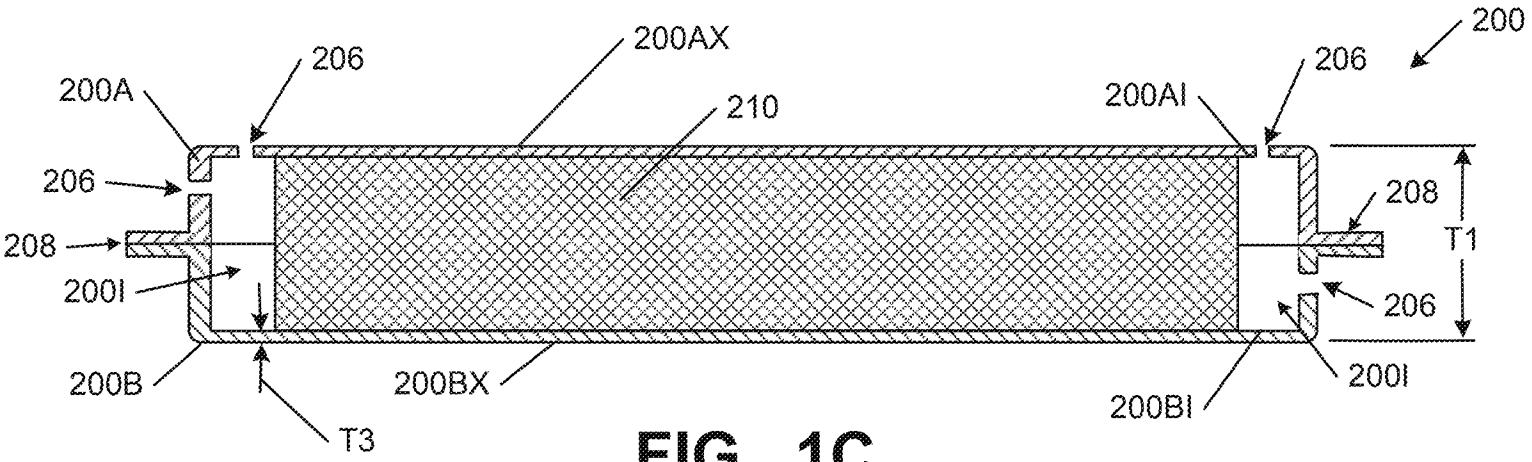
Figure 1D:
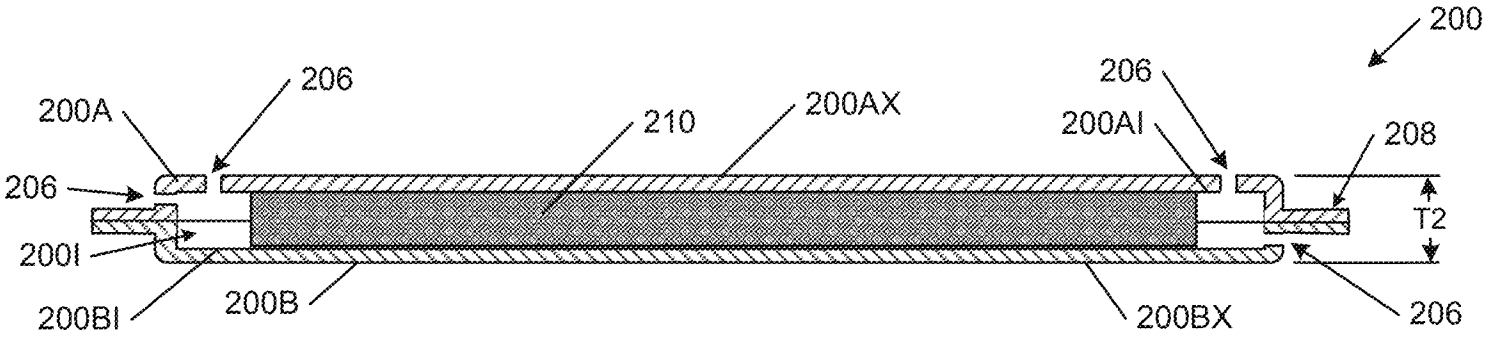
Figure 1E:
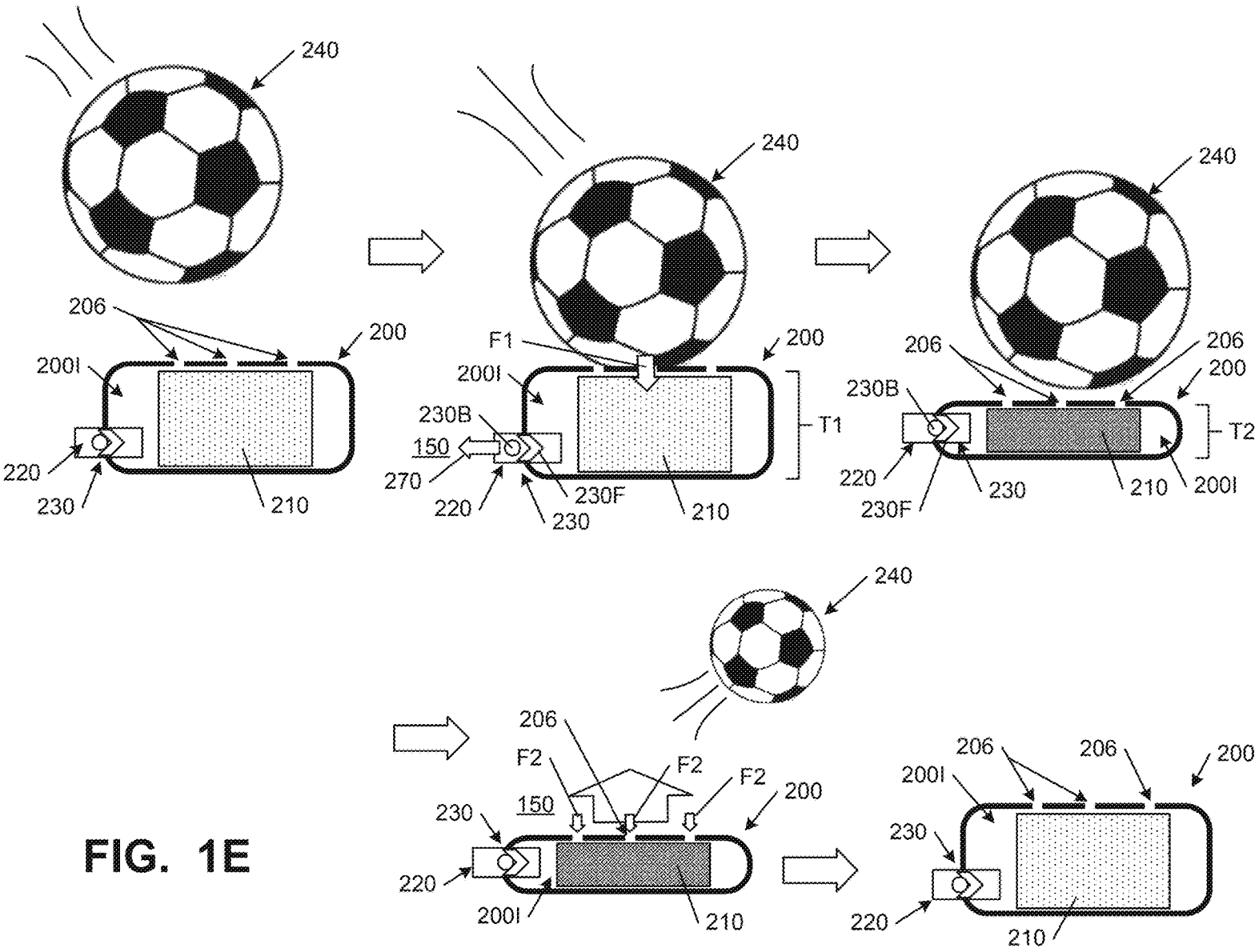

FIGS. 1A-1E illustrate bladders 200, a pair of gloves 100R and 100L including such bladders 200, and their use in accordance with at least some examples of this technology. More specifically: FIG. 1A shows a pair of gloves 100R and 100L, each including a bladder 200 in accordance with some aspects of this technology; FIG. 1B provides a larger view of a portion of the bladder 200 of FIG. 1A to show the fluid line and valve components; FIG. 1C shows a cross sectional view of bladder 200 taken along line 1C-1C in FIG. 1B in an expanded configuration; FIG. 1D shows a cross sectional view of bladder 200 taken along line 1C-1C in FIG. 1B in a compressed configuration; and FIG. 1E illustrates use of bladder 200 in some examples of this technology.

As shown in FIG. 1A, each of the gloves 100R, 100L includes a glove structure including a glove base member 102 (e.g., formed from one or more component parts) and a hand-receiving opening 1020. The glove base member 102 may have any desired construction, number of parts, features, or the like, without departing from this technology, including conventional constructions, parts, features, etc. as are known and used in the glove art. As some more specific examples, the glove base member 102 may be formed, at least in part, from one or more textile elements, one or more leather components (e.g., natural or synthetic), and/or one or more plastic components. The glove base member 102 also may be formed in any desired manner, including manners conventionally known and used in the glove art. The glove base members 102 may have structures corresponding to conventional gloves (e.g., conventional sports gloves). FIG. 1A illustrates the palm sides of this example pair of gloves 100R, 100L.

In this specific illustrated example, the glove base member 102 includes a thumb-receiving portion 104 and four finger-receiving portions 106A, 106B, 106C, and 106D. While FIG. 1A shows the thumb-receiving portion 104 and the four finger-receiving portions 106A, 106B, 106C, and 106D having closed ends, one or more of these portions may have open ends (e.g., so that at least some portion of the wearer's thumb and/or finger(s) may stick out through the open end(s)).

As shown in FIG. 1A, each of these example gloves 100R, 100L includes a bladder 200 engaged with one or more glove base member 102 components, e.g., by adhesives or cements, by stitching (e.g., at least one sewn seam), by mechanical fasteners, etc. Alternatively, if desired, the bladder(s) 200 may be releasably engaged one or more glove base member 102 components. An exterior surface of the bladder 200 may be engaged to an exterior glove component (e.g., as shown in FIG. 1A). The bladder 200 of this example is engaged with an exterior surface of a palm portion, an index finger portion, and a thumb portion of the glove base member 102. Additionally or alternatively, if desired, the bladder 200 may be fixed between layers of the glove base member 102 (e.g., and optionally exposed through one or more openings in the glove base member 102) and/or located at least partially inside an outermost layer of the glove base member 102. In some examples of this technology, an exterior surface of the bladder 200 may be fixed to the glove base member 102, e.g., in any of the manners described in U.S. Patent Appln. Publn. Nos. 2023/0141164 A1, 2023/0141325 A1, 2023/0146597 A1, and 2023/0147306 A1, each of which is entirely incorporated herein by reference.

In the example of FIG. 1A, the bladders 200 (including their interior chambers 200I) are sized, shaped, and configured to be located and substantially cover the thumb and index finger as well as a portion of a palm of the wearer's hand between the thumb and index finger. Thus, each of the bladders 200 of this example includes: (a) a thumb chamber portion 250, (b) an index finger chamber portion 252, and (c) a palm chamber portion 254 (which also may be considered a "base chamber region" of the bladder 200). The thumb chamber portion 250, index finger chamber portion 252, and palm chamber portion 254 of this example are in fluid communication with one another via: (i) fluid passageway 250P placing the thumb chamber portion 250 in fluid communication with the palm chamber portion 254 and (ii) fluid passageway 252P placing the index finger chamber portion 252 in fluid communication with the palm chamber portion 254. Thus, in this example, the entire interior chamber 200I of each bladder 200 is in open fluid communication. Gloves 100R, 100L with these bladder 200 structures are well suited as soccer gloves, with the bladders 200 placed at positions on the wearer's hands to attenuate forces incident when a player (e.g., a goalie) catches a soccer ball with both hands.

While other options are possible, in at least some examples of this technology, the bladder 200 will be formed prior to engaging the bladder 200 with the one or more component parts of the glove base member 102. The bladder 200 may be inflated before or after it is engaged with the glove base member 102.

FIG. 1A further shows that in this illustrated example, each of the thumb chamber portion 250, index finger chamber portion 252, and palm chamber portion 254 has a multi-lobed chamber construction. More specifically, the thumb chamber portion 250 of this example includes: (i) a first thumb chamber lobe 250A that is connected with the palm chamber portion 254 via fluid passageway 250P and (ii) a second thumb chamber lobe 250B that is connected with the first thumb chamber lobe 250A by another fluid passageway 250C. Similarly, the index finger chamber portion 252 of this example includes: (i) a first index finger chamber lobe 252A that is connected with the palm chamber portion 254 via fluid passageway 252P and (ii) a second index finger chamber lobe 252B that is connected with the first index finger chamber lobe 252A by another fluid passageway 252C. Also, the palm chamber portion 254 of this example includes: (i) a first palm chamber lobe 254A connected with (ii) a second palm chamber lobe 254B via fluid passageway 254C. First palm chamber lobe 254A connects with fluid passageway 250P (and thus with the thumb chamber portion 250), and second palm chamber lobe 254B connects with fluid passageway 252P (and thus with the index finger chamber portion 252). In at least some examples of this technology, one or more of the fluid passageways 250P, 252P, 250C, 252C, and 254C may be formed by a seam 208 of the bladder 200 forming a narrowing of the interior chamber 200I of the bladder 200 at the locations of the fluid passageway(s) 250P, 252P, 250C, 252C, and/or 254C. Additionally or alternatively, in at least some examples of this technology, one or more of the fluid passageways 250P, 252P, 250C, 252C, and/or 254C may be provided at locations to provide flexion regions, e.g., for the thumb, index finger, and/or palm portions of the gloves 100R, 100L. The flexion regions may be located to correspond to one or more joints or bend regions of the wearer's thumb, index finger, palm, and/or hand.

This example bladder 200 structure and potential functions will be described in more detail additionally in conjunction with FIGS. 1B-1D. This example bladder 200 includes a thermoplastic envelope or chamber wall (e.g., formed from a first thermoplastic layer 200A fixed to a second thermoplastic layer 200B at a seam 208). Exterior surface 200AX of bladder 200 may be at least partially exposed in the final glove 100R, 100L structure, and/or exterior surface 200BX may face and/or contact a glove base member 102 component part (and may be engaged with a glove base member 102 component part). An interior chamber 200I is defined by the thermoplastic envelope or chamber wall (e.g., between the first thermoplastic layer 200A and the second thermoplastic layer 200B and inside the seam 208). The first thermoplastic layer 200A and the second thermoplastic layer 200B may be formed from one or more sheets of thermoplastic elastomer material, including materials of the types that are conventionally known and used in the footwear bladder arts. The seam 208 can be formed in any suitable manner, including through the use of adhesives, welding techniques (e.g., RF welding, ultrasonic welding, etc.), including in manners as are conventionally known and used in the footwear bladder art. In some examples of this technology, the seam 208 may form a continuous perimeter seam that extends around an entire exterior perimeter of the bladder 200 except at a single location where a fluid line 220 interrupts the seam 208. The seam 208 may form a base through which the bladder 200 may be engaged with a component part of the glove base member 102, e.g., by an adhesive, by stitching through the seam 208, by a mechanical connector extending through the seam 208, etc. Exterior surfaces 200AX and/or 200BX and/or the seam 208 of the bladder 200 may be attached to one or more component parts of the glove base member 102.

The interior chamber 200I of this example bladder 200 includes a foam material 210 located therein (e.g., formed from one or more foam component parts). The foam material 210 is shown in FIG. 1A (and in FIGS. 2 and 3) by diagonal hatching. The foam material 210 may be fixed to one or both interior surfaces 200AI, 200BI of the thermoplastic layers 200A, 200B, respectively, e.g., by adhesives. Alternatively, the foam material 210 may be unfixed within interior chamber 200I. The foam material 210 may be placed in the interior chamber 200I prior to formation of the seam 208 that fixes the first thermoplastic layer 200A with the second thermoplastic layer 200B (and thus fixes the foam material 210 within the interior chamber 200I). While FIG. 1A shows each individual lobe 250A, 250B, 252A, 252B, 254A, and 254B as including one separate piece of foam material 210, the interior chamber 200I of the bladder 200 may have any desired number of pieces of foam material 210 (e.g., with an individual lobe including one or more pieces of foam material and/or with one piece of foam material 210 bridging between two or more lobes).

This example bladder 200 further includes at least one fluid line (e.g., fluid line 220) in fluid communication with the interior chamber 200I (e.g., with the palm chamber portion 254, such as with the first palm chamber lobe 254A) and with (e.g., opening into) an external environmental area 150 (e.g. the open air). At least one valve (e.g., valve 230) is located within (or otherwise associated with) the fluid line 220 (shown simplified in FIG. 1A). The valve(s) 230 may comprise a one-way valve located and configured with respect to the fluid line 220 to allow fluid to exit the interior chamber 200I of the bladder 200 via the fluid line 220 but to inhibit fluid from the external environmental area 150 from entering the interior chamber 200I via the fluid line 220. While other valve 230 constructions are possible, FIG. 1B shows valve 230 including: (a) a fixed valve component 230F (e.g., a valve seat component), (b) a movable valve component 230B (e.g., a ball) to open and close an opening 230O through the fixed valve component 230F, and (c) a biasing member 230S (e.g., spring, resilient member (such as a foam block), etc.) to bias the movable valve component 230B toward the fixed valve component 230F (so that the valve 230 typically is biased to a closed configuration). FIG. 1B shows the valve 230 in an open configuration or condition in which fluid pressure within interior chamber 200I applies a force to the movable valve component 230B (through opening 230O) that exceeds the biasing force applied to the movable valve component 230B by biasing member 230S (e.g., when a game projectile contacts the bladder 200). This configuration unseats the movable valve component 230B from the fixed valve component 230F and opens fluid line 220 to allow fluid to exit the interior chamber 200I and move to the external environmental area 150. This valve 230 "crack pressure," in some examples of this technology, may be approximately 0.5 psi (i.e., so that the valve 230 opens when pressure within the interior chamber 200I is at least 0.5 psi greater than the surrounding pressure in the external environmental area 150), and in some examples, within a range of 0.1 psi to 2 psi, or 0.25 psi to 1.25 psi.

When fluid pressure in the interior chamber 200I is not sufficient to move and/or hold the movable valve component 230B against the biasing force of biasing member 230S, the biasing member 230S will push the movable valve component 230B against the fixed valve component 230F, thereby placing fluid line 220 in a closed configuration or condition (with movable valve component 230B pushed tightly against fixed valve component 230F).

This example bladder 200 further includes one or more through hole openings 206 defined through the thermoplastic envelope or chamber wall (e.g., through at least one of the first thermoplastic layer 200A or the second thermoplastic layer 200B). The through hole opening(s) 206 open into the interior chamber 200I of the bladder 200 and permit fluid from the external environmental area 150 to enter the interior chamber 200I. The through hole opening(s) 206, however, is/are sized shaped, and arranged so that fluid enters the interior chamber 200I through the through hole opening(s) 206 at a rate that slows or delays re-expansion of the foam material 210 in the interior chamber 200I to its full expanded configuration. As a more specific example, if foam material 210 was compressed or flattened in the open external environment area 150, it would re-expand at its natural rate (e.g., depending on porosity, type of foam material, atmospheric pressure, etc.). But, within interior chamber 200I, because through hole opening(s) 206 are small sized, fluid (e.g., air) from the external environmental area 150 will re-fill interior chamber 200I at a slowed rate. Thus, foam material 210 will re-expand at a slowed rate. In at least some examples of this technology, the through hole opening(s) 206 will be sized, spaced, and/or relatively positioned such that foam material 210 may take from 2 to 10 seconds to re-expand to its expanded size within the interior chamber 200I. Foam material 210 may apply a force against the interior surfaces 200AI, 200BI of the interior chamber 200I at least during some period of its re-expansion.

Thus, the through hole opening(s) 206 typically will be small sized to delay and control (e.g., tune) the refilling rate of the interior chamber 200I and re-expansion of the foam material 210. As some more specific examples, the through hole opening(s) 206 may define a length direction extending through one of the first thermoplastic layer 200A or the second thermoplastic layer 200B and a width direction extending across the respective through hole opening 206. At least one (and optionally some or even all) of the through hole openings 206 may have a width dimension across the width direction (e.g., a diameter or a longest diagonal dimension) of less than 2 mm, and in some examples, less than 1.5 mm, less than 1 mm, less than 0.75 mm, or even less than 0.5 mm. One, some, or all of the through hole openings 206 may have a "pinpoint" size (e.g., less than 0.3 mm in diameter or longest diagonal dimension in the width direction). The through hole openings 206 shown in FIGS. 1A-1E may be somewhat exaggerated in size to assure they are clearly discernible in these drawings.

FIGS. 1C-1E further illustrate some example uses of aspects of this technology when interacting with a game ball 240 or other projectile. While the discussion below specifically uses the term "game ball," another type of projectile (e.g., a hockey puck) may interact with the bladder 200 in the same manner as the game ball 240. Prior to the interaction, the foam material 210 in the bladder 200 may be in an expanded configuration, e.g., as shown in FIG. 1C and at the top left of FIG. 1E. When the game ball 240 contacts the bladder 200 (directly if the bladder 200 is exposed at the exterior of the glove 100R, 100L or through a layer of the glove base member 102), the impact force F1 (if sufficient) will compress the foam material 210 and force fluid (e.g., air) out of the interior chamber 200I through the first fluid line 220 (assuming the fluid force generated inside interior chamber 200I is sufficient to move the movable valve component 230B away from the fixed valve component 230F against the biasing force of biasing member 230S). See impact force arrow F1 and fluid flow arrow 270 in the top middle of FIG. 1E. This action changes: (a) bladder 200 thickness from T1 to T2, and (b) changes foam material 210 and bladder 200 from the expanded configuration to the compressed configuration, as shown in a comparison of FIGS. 1C and 1D and a comparison of the top-middle and top-right portions of FIG. 1E. In some examples of this technology, the expanded thickness T1 of the bladder 200 may be at least 2 mm, and in some examples, at least 2.5 mm, at least 3 mm, or even at least 4 mm. Additionally or alternatively, in some examples, the expended thickness T1 may be less than 12 mm, and in some examples, less than 10 mm, less than 8 mm, or even less than 6 mm.

Once the impact force F1 is sufficiently relaxed or removed (e.g., as the game ball 240 begins to move away from the bladder 200 and/or its motion is stopped), the movable valve component 230B will re-seat on the fixed valve component 230F (due to force from biasing member 230S) thereby sealing fluid line 220. Because through hole opening(s) 206 are small, fluid from the external environmental area 150 will begin to be admitted to the interior chamber 200I through the through hole opening(s) 206, but at an overall fluid entry rate that delays expansion of the foam material 210 back to its expanded configuration. See fluid arrows F2 at the bottom left of FIG. 1E. Thus, expansion of the foam material 210 may continue even after the game ball 240 is away from the bladder 200. While foam material 210 may push outward on the interior surfaces 200AI and 200BI of the bladder 200, the slow entry of air into the interior chamber 200I via through hole opening(s) 206 delays transfer of the foam material 210 to its expanded state. Over time, fluid from the external environmental area 150 will re-expand the bladder 200 and the foam material 210 to their expanded configurations. See FIG. 1C and the bottom right of FIG. 1E.

As noted above, the number and/or overall size of the through hole opening(s) 206 may be controlled to control or tune the rate of re-expansion of the foam material 210. As some more specific examples, the number, overall size(s), and/or arrangements of the through hole opening(s) 206 may be selected so that the foam material 210 re-expansion rate within the interior chamber 200I may take up to 12 seconds, up to 10 seconds, from 1 to 10 seconds, from 2 to 10 seconds, from 2 to 8 seconds, or even from 2 to 6 seconds. Additionally, the thicknesses (e.g., note thickness dimension T3 in FIG. 1C) of the thermoplastic layers 200A, 200B or chamber wall(s) may be controlled to provide desired properties, such as desired mass properties (e.g., sufficiently lightweight), desired stiffness properties, sufficient durability, etc. The thicknesses of the thermoplastic layer(s) 200A, 200B may be varied over the surface area of the bladder 200. As some more specific examples, the thickness (e.g., T3) of the thermoplastic layers 200A, 200B or chamber wall(s) may be constant or varied and/or within a range of 20 to 1000 microns, and in some examples, from 25 to 500 microns, or from 30 to 300 microns.

Because of the presence of the foam material 210, the change of the foam material 210 from the expanded configuration to the compressed configuration in response to contact with the game ball 240, and the slowed re-expansion rate of the foam material 210, at least some impact force of the game ball 240 with the bladder 200 will be absorbed. This may assist the wearer in catching the game ball 240 or it may cause the game ball 240 to bound away from the bladder 200 with less force than would be the case if the foam material 210 and bladder 200 were not present and/or if the foam material 210 was permitted to quickly re-expand to its expanded state. If the wearer does not catch the ball, the absorption of some game ball 240 rebound force will tend to cause the game ball 240 to bounce away less aggressively than otherwise would be the case, thereby keeping the game ball 240 closer to the player that contacted it. These features can help the player maintain control and possession of the game ball 240. The delayed re-expansion of the foam material 210 also may keep the foam material 210 in a compressed configuration as the wearer picks the game ball 240 out of the glove 100R, 100L (if necessary) and throws it during further play. In this manner, the throwing action tends to feel normal for the wearer (because the foam material 210 may still be compressed while the game ball 240 is being handled by the wearer).

The foam material 210 may comprise a resilient polymer foam (e.g., an open cell foam material), such as a polyurethane foam, an ethylvinylacetate foam, or other foam material (e.g., foam rubbers, closed cell foams, etc.). Any desired size and/or volume of foam material 210 may be provided in the interior chamber 200I in various specific examples of this technology. As some more specific examples, the interior chamber 200I may define a first volume V1 (e.g., the volume defined by the first thermoplastic layer 200A, the second thermoplastic layer 200B, and inside the seam 208). In the fully expanded configuration within the interior chamber 200I, the foam material 210 (e.g., the combined volume of all foam material 210 pieces within the interior chamber 200I) may define a volume of V2. In some examples of this technology: (a) V2 may be at least 50% of V1, at least 60% of V1, or even at least 75% of V1, and/or (b) V2 may be less than 98% of V1, and in some examples, less than 95% of V1, less than 90% of V1, or even less than 85% of V1.

Various properties of the foam material 210 (or other resilient components described below) may be controlled to provide the desired properties and response (e.g., ball interaction properties). As some more specific examples, the foam material 210's resilience properties may be varied, e.g., to provide the desired ball rebound effects. For example, the foam material 210 may have a resiliency of 0 to 80% (e.g., measured in a ball drop test (e.g., according to ASTM Standard D2632) in which the resiliency percentage corresponds to the ball's rebound height (RH) as a percentage of the ball drop height (DH), i.e., (Resiliency=RH/DH× 100)). In some examples, the resiliency will be within a range of 2% to 70%, or 2.5% to 50%. Additionally or alternatively, the foam material 210 may have various stiffness properties. As some more specific examples, the foam material 210's secant stiffness (measuring using a load of 2000 N) may be within a range of 15-1000 N/mm, and in some examples, within a range of 20-800 N/mm or even 25-600 N/mm.

Figure 2:
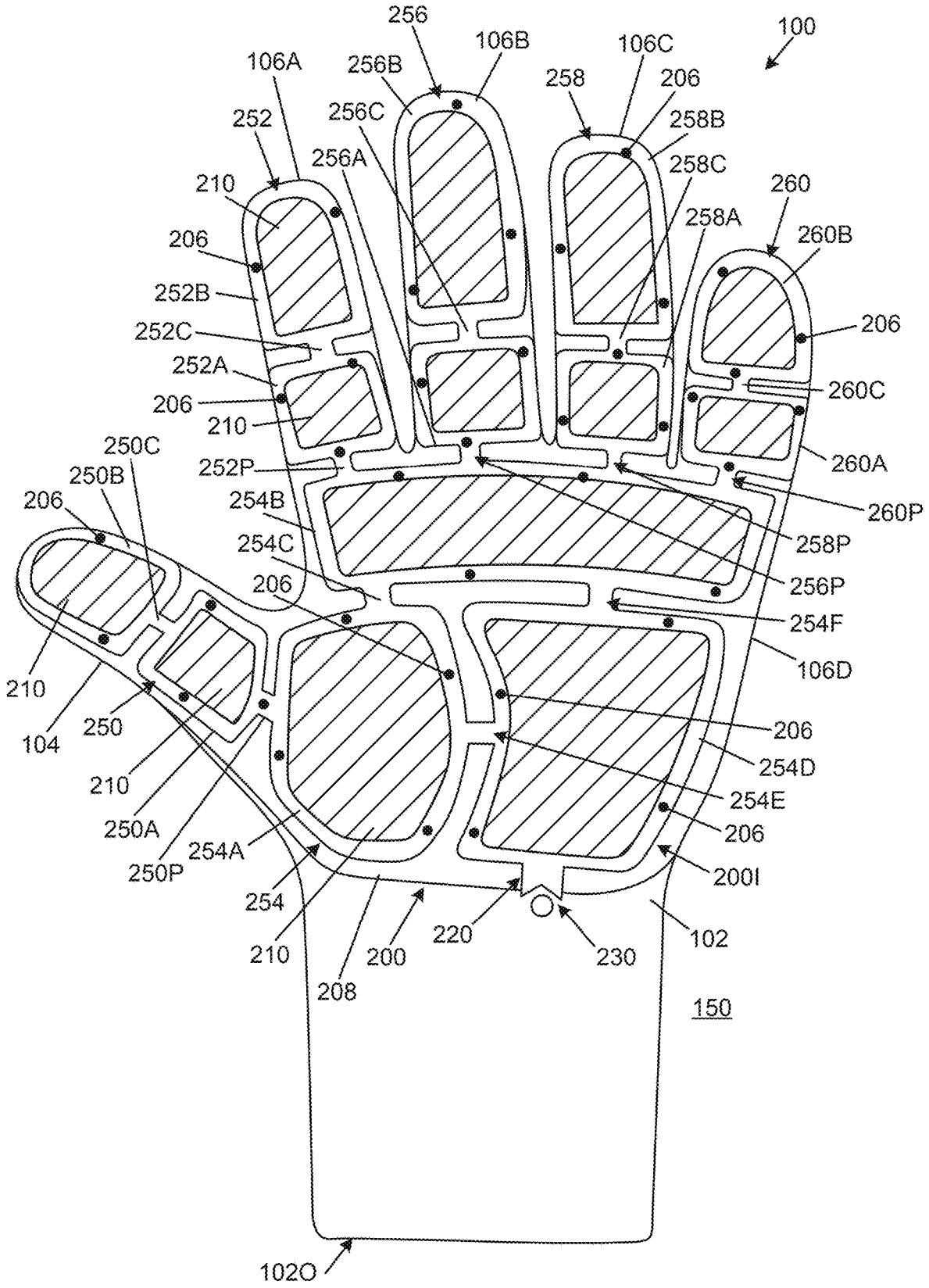
FIG. 2 illustrates another example of bladders and gloves in accordance with some examples of this technology.

Many variations in the size, shape, and/or location of the bladder 200 may be provided in other specific examples of this technology. For example, FIG. 2 illustrates another example glove 100 structure in accordance with some aspects of this technology (the palm side of a left hand glove 100 shown, but a corresponding right hand glove may constitute a mirror image of the illustrated left hand glove 100). In this illustrated example, the bladder 200 extends to cover all or substantially all of the palm-side of a wearer's hand. Where the same reference numbers are used in FIG. 2 as are used in FIGS. 1A-1E discussed above, the same or similar parts and/or features are being referenced (including any of the features, options, or alternatives described above for those parts and/or features), and much of the overlapping description may be omitted. The glove 100 of FIG. 2 may function in the same general manner as the gloves 100R, 100L of FIGS. 1A-1E and/or have any one or more of the properties of those gloves 100R, 100L described above, including but not limited to: the thickness properties; the foam re-expansion properties; the volume and relative volume properties (e.g., V1 and V2 described above); the resiliency properties; and/or the stiffness properties.

Similar to the structure of FIG. 1A, the example glove 100 of FIG. 2 includes a glove base member 102 that includes a thumb-receiving portion 104 and four finger-receiving portions 106A, 106B, 106C, and 106D. The glove base member 102 includes a palm portion configured to cover at least a portion of a wearer's palm (and all of the palm, in this illustrated example) when inserted into the glove 100.

As shown in FIG. 2, the glove 100 includes a bladder 200 engaged with one or more glove base member 102 components, e.g., by adhesives or cements, by stitching (at least one sewn seam), by mechanical fasteners, etc. Alternatively, if desired, the bladder(s) 200 may be releasably engaged one or more glove base member 102 components. An exterior surface of the bladder 200 may be engaged to an exterior glove component (e.g., as shown in FIG. 2). The bladder 200 of this example is engaged with an exterior surface of a palm portion of the glove base member 102. Additionally or alternatively, if desired, the bladder 200 may be fixed between layers of the glove base member 102 (e.g., and optionally exposed through one or more openings in the glove base member 102) and/or located at least partially inside an outermost layer of the glove base member 102. An exterior surface of the bladder 200 may be fixed to the glove base member 102, e.g., in any of the manners described above for the example of FIG. 1A.

In the example of FIG. 2, the bladder 200 (including its interior chamber 200I) is sized, shaped, and configured to be located and substantially cover the thumb, the four fingers, and the palm portion of the wearer's hand. Thus, bladder 200 of this example includes: (a) a thumb chamber portion 250, (b) an index finger chamber portion 252 (or a first finger chamber portion), (c) a second finger chamber portion 256, (d) a third finger chamber portion 258, (e) a fourth finger chamber portion 260, and (f) a palm chamber portion 254 (or a "base chamber region" of the bladder 200). The thumb chamber portion 250, the four finger chamber portions 252, 256, 258, 260, and the palm chamber portion 254 of this example are in fluid communication with one another via: (i) fluid passageway 250P placing the thumb chamber portion 250 in fluid communication with the palm chamber portion 254, (ii) fluid passageway 252P placing the index finger chamber portion 252 in fluid communication with the palm chamber portion 254, (iii) fluid passageway 256P placing the second finger chamber portion 256 in fluid communication with the palm chamber portion 254, (iv) fluid passageway 258P placing the third finger chamber portion 258 in fluid communication with the palm chamber portion 254, and (v) fluid passageway 260P placing the fourth finger chamber portion 260 in fluid communication with the palm chamber portion 254. Thus, in this example, the entire interior chamber 200I of bladder 200 is in open fluid communication. Gloves 100 with this bladder 200 structure are well suited as goalie gloves for soccer and other sports, with the bladders 200 placed at positions on the wearer's hands to attenuate forces incident when a goalie catches or otherwise interacts with a ball or other projectile.

FIG. 2 further shows that in this illustrated example, each of the thumb chamber portion 250, the four finger chamber portions 252, 256, 258, and 260, and the palm chamber portion has a multi-lobed chamber construction. More specifically, the bladder 200 of this example includes:

(i) Thumb chamber portion 250 that includes a first thumb chamber lobe 250A that is connected with the palm chamber portion 254 via fluid passageway 250P and a second thumb chamber lobe 250B that is connected with the first thumber chamber lobe 250A by another fluid passageway 250C;

(ii) Index finger chamber portion 252 that includes a first index finger chamber lobe 252A that is connected with the palm chamber portion 254 via fluid passageway 252P and a second index finger chamber lobe 252B that is connected with the first index finger chamber lobe 252A by another fluid passageway 252C;

(iii) Second finger chamber portion 256 that includes a finger chamber lobe 256A that is connected with the palm chamber portion 254 via fluid passageway 256P and another finger chamber lobe 256B that is connected with finger chamber lobe 256A by another fluid passageway 256C;

(iv) Third finger chamber portion 258 that includes a finger chamber lobe 258A that is connected with the palm chamber portion 254 via fluid passageway 258P and another finger chamber lobe 258B that is connected with finger chamber lobe 258A by another fluid passageway 258C; and (v) Fourth finger chamber portion 260 that includes a finger chamber lobe 260A that is connected with the palm chamber portion 254 via fluid passageway 260P and another finger chamber lobe 260B that is connected with finger chamber lobe 260A by another fluid passageway 260C.

Also, the palm chamber portion 254 of this example includes: (i) a first palm chamber lobe 254A; (ii) a second palm chamber lobe 254B; and (iii) a third palm chamber lobe 254D. First palm chamber lobe 254A connects with: (a) the first thumb chamber lobe 250A via fluid passageway 250P, (b) the second palm chamber lobe 254B via fluid passageway 254C, and (c) the third palm chamber lobe 254D via fluid passageway 254E. The second palm chamber lobe 254B of this example connects with: (a) the first palm chamber lobe 254A via fluid passageway 254C, (b) the third palm chamber lobe via fluid passageway 254F, (c) the first index finger chamber lobe 252A via fluid passageway 252P, (d) the second finger chamber lobe 256A via fluid passageway 256P, (e) the third finger chamber lobe 258A via fluid passageway 258P, and (f) the fourth finger chamber lobe 260A via fluid passageway 260P. The third palm chamber lobe 254D of this example connects with: (a) the first palm chamber lobe 254A via fluid passageway 254E and (b) the second palm chamber lobe 254B via fluid passageway 254F. In at least some examples of this technology, one or more of the fluid passageways 250P, 252P, 250C, 252C, 254C, 254E, 254F, 256P, 256C, 258P, 258C, 260P, and 260C may be formed by the seam 208 of the bladder 200 forming a narrowing of the interior chamber 200I of the bladder 200 at the locations of the fluid passageway(s) 250P, 252P, 250C, 252C, 254C, 254E, 254F, 256P, 256C, 258P, 258C, 260P, and/or 260C. Additionally or alternatively, in at least some examples of this technology, one or more of the fluid passageways 250P, 252P, 250C, 252C, 254C, 254E, 254F, 256P, 256C, 258P, 258C, 260P, and/or 260C may be provided at locations to provide flexion regions for the thumb, fingers, and/or palm portions of the glove 100. The flexion regions may be located to correspond to one or more joints or bend regions of the wearer's thumb, fingers, palm, and/or hand.

Similar to the example of FIG. 1A, the example glove 100 of FIG. 2 includes a fluid line 220 and valve 230 configuration of the types described above. While other options are possible, the fluid line 220 of this example opens into the palm chamber portion 254 of the bladder 200 (and more specifically, into the third palm chamber lobe 254D). As other alternatives, if desired, the fluid line 220 and valve 230 structure could be provided to open into the first palm chamber lobe 254A, the second palm chamber lobe 254B, any part of the thumb chamber portion 250, and/or any part of one of the finger chamber portions 252, 256, 258, 260.

Figure 3:
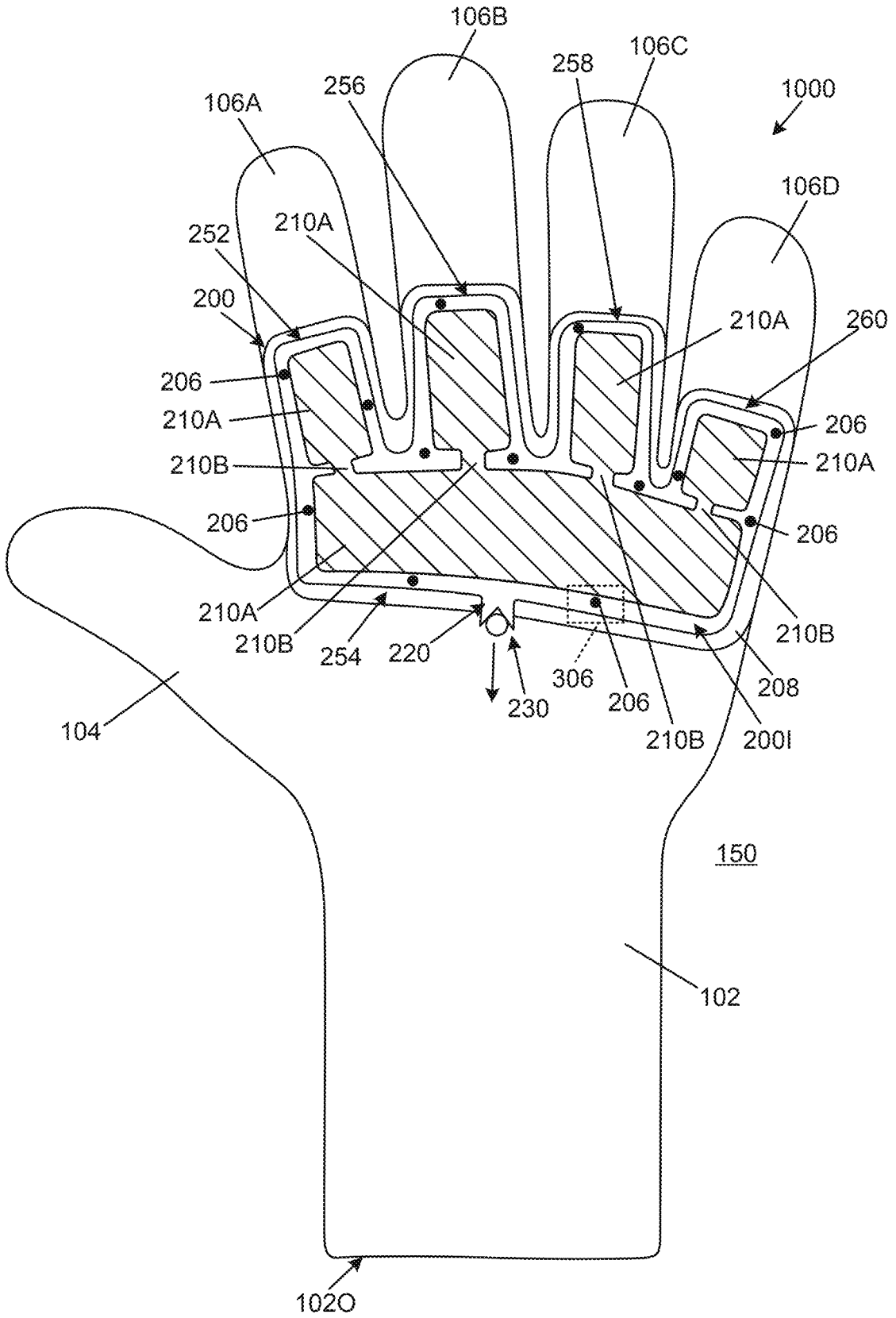
FIG. 3 illustrates another example of bladders and gloves in accordance with some examples of this technology.

FIG. 3 illustrates another example glove 1000 structure in accordance with some aspects of this technology (the back side of a right hand glove 1000 shown, but a corresponding left hand glove may constitute a mirror image of the illustrated right hand glove 1000). In this illustrated example, the bladder 200 extends to cover the knuckles and lower finger areas at the rear side of a wearer's hand. Where the same reference numbers are used in FIG. 3 as are used in FIGS. 1A-2 discussed above, the same or similar parts and/or features are being referenced (including any of the features, options, or alternatives described above for those parts and/or features), and much of the overlapping description may be omitted. The glove 1000 of FIG. 3 may function in the same general manner as the gloves 100R, 100L, 100 of FIGS. 1A-2 and/or have any one or more of the properties of those gloves 100R, 100L, 100 described above, including but not limited to: the thickness properties; the foam re-expansion properties; the volume and relative volume properties (e.g., V1 and V2 described above); the resiliency properties; and/or the stiffness properties.

The example glove 1000 of FIG. 3 includes a glove base member 102 that includes a thumb-receiving portion 104 and four finger-receiving portions 106A, 106B, 106C, and 106D. The glove base member 102 includes a rear portion configured to cover at least a portion of a back surface of a wearer's hand (and all of the back surface of the wearer's hand, in this illustrated example) when inserted into the glove 1000. While FIG. 3 shows the thumb-receiving portion 104 and the four finger-receiving portions 106A, 106B, 106C, and 106D having closed ends, one or more of these portions may have open ends (e.g., so that at least some portion of the wearer's thumb and/or finger(s) may stick out through the open end(s)).

As shown in FIG. 3, the glove 1000 includes a bladder 200 engaged with one or more glove base member 102 components, e.g., by adhesives or cements, by stitching (at least one sewn seam), by mechanical fasteners, etc. Alternatively, if desired, the bladder(s) 200 may be releasably engaged one or more glove base member 102 components. An exterior surface of the bladder 200 may be engaged to an exterior glove component (e.g., as shown in FIG. 3). The bladder 200 of this example is engaged with an exterior surface of a rear portion of the glove base member 102. Additionally or alternatively, if desired, the bladder 200 may be fixed between layers of the glove base member 102 (e.g., and optionally exposed through one or more openings in the glove base member 102) and/or located at least partially inside an outermost layer of the glove base member 102. An exterior surface of the bladder 200 may be fixed to the glove base member 102, e.g., in any of the manners described above for the example of FIG. 1A.

In the example of FIG. 3, the bladder 200 (including its interior chamber 200I) is sized, shaped, and configured to be located and substantially cover the knuckles and lower finger areas at the rear side of a wearer's hand. Thus, bladder 200 of this example includes: (a) an index finger chamber portion 252 (or a first finger chamber portion), (b) a second finger chamber portion 256, (c) a third finger chamber portion 258, (d) a fourth finger chamber portion 260, and (e) a base chamber region 254 (or a knuckle covering region). The four finger chamber portions 252, 256, 258, 260, and the base chamber region 254 of this example are in fluid communication with one another, i.e., the entire interior chamber 200I of bladder 200 is in open fluid communication. Gloves 1000 with this bladder 200 structures are well suited for goalie gloves for soccer and other sports, with the bladders 200 placed at positions on the wearer's hands to attenuate forces incident when a goalie punches at a soccer ball in an effort to deflect it in a direction away from the goal.

The example of FIG. 3 differs from the example of FIG. 2 in that the bladder 200 of FIG. 3 does not include narrowed fluid passageways 252P, 256P, 258P, and 260P between the base chamber region 254 and the finger chamber portions 252, 256, 258, and 260. Rather, the interior chamber 200I of the example of FIG. 3 has a wider open interior construction that allows free flow of fluid. Thus, the example of FIG. 3 does not include the multi-lobed chamber construction of the type shown in FIG. 2. Alternatively, if desired, the bladder 200 for the glove 1000 of FIG. 3 could have a multi-lobed construction with narrowed fluid passageways, e.g., of the structure illustrated by the combination of palm chamber lobe 254B with first index finger chamber lobe 252A, second finger chamber lobe 256A, third finger chamber lobe 258A, and fourth finger chamber lobe 260A (connected by narrowed fluid passageways 252P, 256P, 258P, and 260P, respectively) shown in FIG. 2. If necessary or desired, the knuckle joint area of the bladder 200 shown in FIG. 3 may include structure to provide or support flexion at the knuckle joints, such as a pre-bend area, perforated seams, etc.

The foam material 210A in the glove 1000 of FIG. 3 also differs from the foam material 210 shown in FIGS. 1A and 2 in that the foam material 210A of FIG. 3 constitutes a single piece of foam material that extends continuously within the base chamber region 254 and into the finger chamber portions 252, 256, 258, and 260 of the bladder 200. In the examples of FIGS. 1A and 2, the foam material 210 is present in several separated pieces (e.g., with a separate foam material 210 piece within each lobe of those multi-lobed constructions). In the example of FIG. 3, the foam material 210A includes narrowed regions 210B extending between the base chamber region 254 and the four finger chamber portions 252, 256, 258, and 260. The narrowed regions 210B help provide a flexion region for the knuckles and/or fingers. Alternatively, if desired, the glove 1000 structure of FIG. 3 may include more than one foam piece within the interior chamber 200I and/or the gloves 100L, 100R, and/or 100 of FIGS. 1A and 2 may include a foam material that extends continuously between any two or more of the lobes of those multi-lobed constructions (e.g., including, if desired, a single piece of foam material 210 in each of gloves 100L, 100R, and 100).

Similar to the examples of FIGS. 1A and 2, the example glove 1000 of FIG. 3 includes a fluid line 220 and valve 230 configuration of the types described above. While other options are possible, the fluid line 220 of this example opens into the base chamber region 254 of the bladder 200. As other examples, if desired, the fluid line 220 and valve 230 structure could be provided to open into any of the finger chamber portions 252, 256, 258, 260.

As evident from FIGS. 1A, 2, and 3, bladders, bladder lobes, bladder chambers, glove base members 102, resilient components, and the arrangements of these parts may take on a wide variety of sizes, shapes, looks, feels, and/or ornamental appearances without affecting the ability of the bladder(s) to perform their desired impact force attenuation and/or delayed foam re-expansion functionalities. The specific sizes, shapes, arrangements, and/or ornamental appearances of the bladder, resilient component(s), glove, and/or glove components can vary widely and still perform the desired functions. Thus, the specifically illustrated ornamental appearances of the bladder, resilient component(s), glove, and/or glove components shown in this application are not critical to performance of the desired functions.

In all of the bladder 200 structures described herein, the size(s) of the through hole opening(s) 206 may be selected to control (tune) the rate at which fluid (e.g., air) from the external environmental area 150 enters the interior chamber 200I of the bladder 200 and re-expands the foam material 210. As some more specific examples of this technology, the size(s) of the through hole opening(s) 206 may be selected so that it takes from 2 seconds to 12 seconds for the foam material 210 and/or bladder chamber or lobes to change from a compressed configuration to an expanded configuration.

The glove 100L, 100R, 100, 1000 structures of FIGS. 1A, 2, and 3 may include additional features that enable a user to further control or tune this re-expansion rate. In any of these example bladders 200, one or more cover members may be provided, e.g., positioned and configured to selectively change one or more of the plurality of through hole openings 206 between an open configuration and a closed configuration. As a more specific example, a cover member 306 may be provided as a separate component that is engageable with the bladder 200 to cover one or more through hole openings 206 and place the through hole opening(s) 206 in a closed configuration. See FIG. 3. The cover member 306 may constitute a plastic sheet, such as a strip of adhesive tape or a sticker. One or more cover members 306 may be provided, e.g., covering any desired number of through hole openings 206. By covering and/or uncovering one or more through hole openings 206 using cover member(s) 306, an overall fluid entry rate into the interior chamber 200I of the bladder 200 can be altered, and thus the foam material 210 (or other resilient component) re-expansion rate can be controlled and tuned.

While the example bladders 200 shown in FIGS. 1A-3 include a single fluid line 220 and valve 230 combination, if desired, a bladder 200 may include two or more fluid lines 220, two or more valves 230, and/or two or more fluid line and valve 230 combinations in fluid communication with the interior chamber 200I. In other words, two (or more) valves 230, two or more fluid lines 220, and/or two or more fluid line 220 and valve 230 combinations of the types described above (e.g., in conjunction with FIG. 1B) may be in fluid communication with a single interior chamber 200I of bladder 200. Any of the bladders 200 described above in conjunction with FIGS. 1A-3 may include two or more fluid lines 220, two or more valves 230, and/or two or more fluid line 220 and valve 230 combinations. Additionally or alternatively, while the example bladders 200 shown in FIGS. 1A-3 have a single open interior chamber 200I (i.e., the entire interior chamber 200I is in open fluid communication in these examples), other example bladders in accordance with aspects of this technology may have separated and independent interior chambers that are not in fluid communication with one another. In such bladder structures, a separate fluid line 220 and/or a separate valve 230 may be provided for each independent interior chamber (at least for each independent chamber where the above described deflation and/or controlled re-inflation features are desired).

Additionally or alternatively, if desired, the valve(s) 230 and/or fluid line(s) 220 may be equipped with a switch 280. Switch 280, shown schematically in FIG. 1B, may be used to selectively enable or disable fluid flow through the valve(s) 230 and/or fluid line(s) 220. The switch(es) 280, when present, may function in any desired manner in different examples of this technology. For example, switch(es) 280 may selectively place a switch part in a position to physically prevent movement of the movable valve component 230B (e.g., to hold the movable valve component 230B either in the open position or the closed position. Additionally or alternatively, as another example, switch(es) 280 may include components that will move to physically bend or kink fluid line 220 and/or physically crush or pinch fluid line 220 to place the fluid line 220 in a closed configuration (e.g., if the fluid line 220 includes a flexible and/or resilient portion). Thus, the switch(es) 280 may have the structure and/or function of a clamp to clamp fluid line 220 closed. In these manners, users can determine whether or not they wish to activate the functions of the bladders 200 (e.g., as described above). With at least some switch 280 structures, the bladders 200 may be held in either an expanded configuration (e.g., as shown in FIG. 1C) or a compressed configuration (e.g., as shown in FIG. 1D), e.g., depending on the configuration when the fluid line 220 is closed. To maintain the bladder 200 in the compressed configuration, one or more cover members 306 may be applied to block the through hole opening(s) 206. Switch(es) 280 of these types may be provided with any one or more of the fluid lines 220 described above in conjunction with FIGS. 1A-3.

Figure 4:
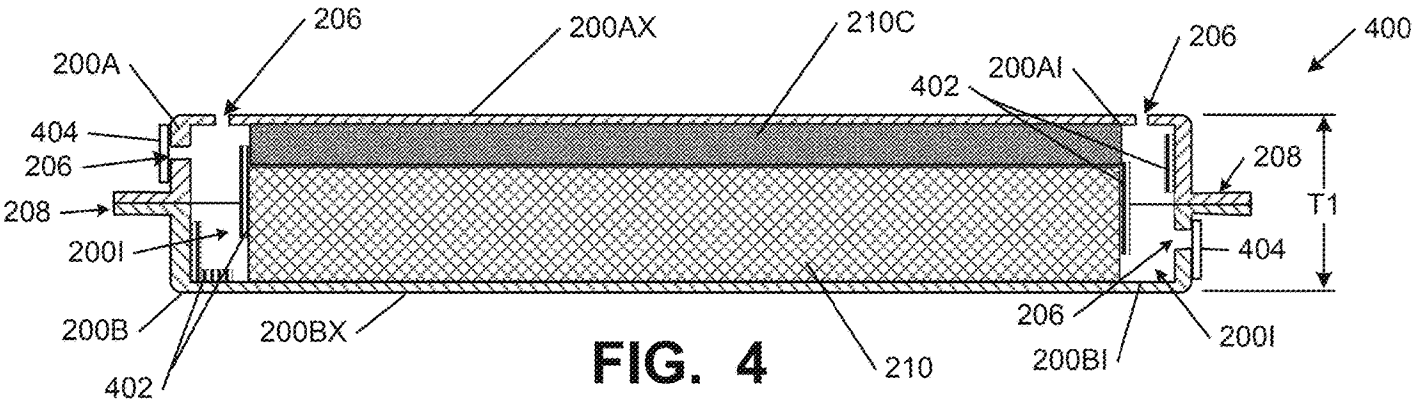
FIG. 4 shows a view similar to FIG. 1C but illustrating additional or alternative features of bladders in accordance with some examples of this technology.

FIG. 4 shows a view of an example bladder 400 similar to the view of FIG. 1C, but with additional and/or different potential features. Where the same reference numbers are used in FIG. 4 as used in FIG. 1C and/or the other figures discussed above, the same or similar parts are being referenced (with any of the features, options, or variations for those parts as described above), and much of the overlapping description may be omitted. As shown in FIG. 4, in some examples of this technology, one or more of the first thermoplastic layer 200A and/or the second thermoplastic layer 200B (e.g., interior surface(s) 200AI, 200BI), the interior chamber 200I, and/or the foam material 210 may include or be treated with (e.g., coated, sprayed, etc.) a biocide material, desiccant, or other growth inhibiting material 402, e.g., to prevent development of mold and/or mildew within the interior chamber 200I.

Additionally or alternatively, if desired, some examples of this technology may include an air permeable membrane 404 over one or more of the through hole openings 206. Such air permeable membranes 404 may allow air to pass through but prevent water from passing into the interior chamber 200I (e.g., a waterproof/breathable membrane, such as a polytetrafluoroethylene film). Air transmission rates through the air permeable membrane(s) 404 also may be controlled (e.g., based on the density and/or thickness of the membrane(s) 404) to provide control, tuning, and/or setting of a desired foam re-expansion rate.

FIG. 4 further shows that this example bladder 400 includes a multi-layer foam (e.g., with a first foam material 210 layer and a second foam material 210C layer shown in the example of FIG. 4). Any number of foam layers may be provided, and the individual foam layers may have foam materials 210, 210C with different properties (e.g., different thicknesses, different densities, different porosities, different resiliencies, different stiffnesses (e.g., secant stiffnesses), etc.). As one more specific example, the outermost foam material (e.g., foam material 210C in this illustrated example) may have a greater density or stiffness (e.g., to remove less rebound force from the ball) while the innermost foam material (e.g., foam material 210 in this illustrated example) may have a lower density or stiffness (e.g., to provide a softer feel against the wearer's hand). Additionally or alternatively, different foam layers and foam materials may be provided at targeted locations on the glove 100R, 100L, 100, 1000 structure.

Any one or more of the additional or alternative features described above in conjunction with FIG. 4 also may be incorporated into any of the other examples of this technology described above in conjunction with FIGS. 1A-3. Additionally or alternatively, any one or more of the specific features described above in conjunction with FIGS. 1A-3 also may be used along with the example structures and features of FIG. 4.

While the discussion above relates to structures that include foam materials 210, 210A, 210C in the interior chamber 200I of a bladder 200, other resilient materials may be used. As some more specific examples, resilient materials and/or resilient components other than foams may be provided within the interior chamber 200I in place of foam material 210, 210A, 210C, such as a resilient plastic block, an elastomeric material (e.g., thermoplastic elastomers), a rubber material, etc.

Figure 5A:
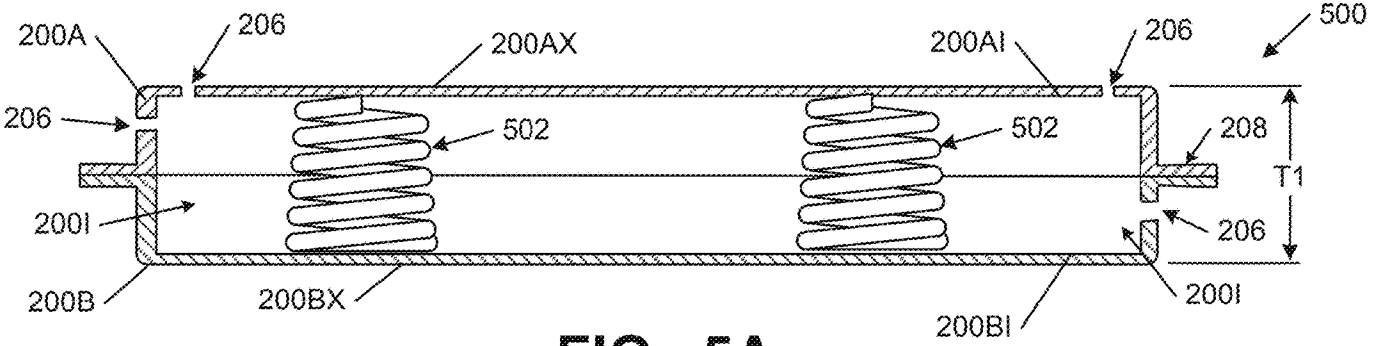
FIGS. 5A and 5B show views similar to FIGS. 1C and 1D, respectively, but illustrating additional or alternative features of bladders in accordance with some examples of this technology.
Figure 5B:
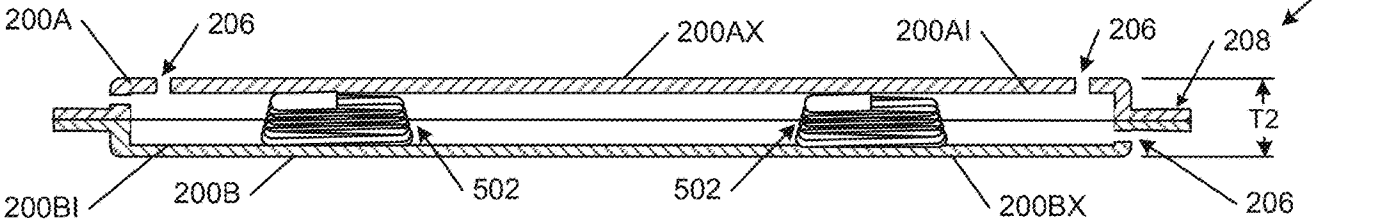

FIGS. 5A and 5B are views similar to the views of FIGS. 1C and 1D, respectively, but with some other potential features. Where the same reference numbers are used in FIGS. 5A and 5B as used in FIGS. 1C and 1D and/or the other figures discussed above, the same or similar parts are being referenced (with any of the features, options, or variations for those parts as described above), and much of the overlapping description may be omitted. As shown in FIGS. 5A and 5B, in some examples of this technology, a bladder 500 may be equipped with one or more resilient components 502 (two non-foam resilient components 502 are shown in the example of FIGS. 5A and 5B). The resilient component(s) 502 may be a block of rubber, elastomer, or other resilient plastic material. In this illustrated example, the resilient components 502 comprise mechanical resilient components in the form of a spring, such as a helical spring, conical spring, coil spring, leaf spring, compression spring, Belleville spring, or other types of springs. Other types of mechanical shock absorbing structures also may be provided as one or more resilient components 502 in other specific examples of this technology. FIG. 5A shows this example bladder 500 in an expanded condition (with resilient component(s) 502 in an expanded state), and FIG. 5B shows this example bladder 500 in a compressed configuration (with resilient component(s) 502 in a compressed state).

The additional or alternative features described above in conjunction with FIGS. 5A and 5B also may be incorporated into any of the other examples of this technology described above in conjunction with FIGS. 1A-4. Additionally or alternatively, any one or more of the specific features described above in conjunction with FIGS. 1A-4 also may be used along with the example structures and features of FIGS. 5A and 5B. Different types of resilient components may be used in a single bladder 200, 400, 500 and/or glove 100L, 100R, 100, 1000 structure. Additionally or alternatively, in some examples of this technology, a single bladder 200, 400, 500 or glove 100L, 100R, 100, 1000 structure may include one or more foam type resilient components (e.g., foam material 210, 210A, 210C) in combination with one or more non-foam resilient components of the types described above.

Additionally, if desired, a single glove 100L, 100R, 100, 1000 may include two or more separate bladders of the types described above. As some more specific examples, a rear mounted bladder (e.g., of the type shown in FIG. 3) may be used on a single glove in combination with a palm mounted bladder (e.g., of the types shown in FIGS. 1A and 2). As another alternative, a single bladder structure may extend around at least one edge of a glove 100L, 100R, 100, 1000 to at least partially cover and provide the impact force attenuation and/or re-expansion control features on both the front and back of the glove 100L, 100R, 100, 1000. When two or more bladders 200 are present in a single glove 100L, 100R, 100, 1000, the two (or more) bladders 200 may be in fluid communication with one another or they may be in fluid isolation from one another. If in fluid isolation, each independent bladder 200 where the desired impact force attenuation and re-expansion properties are desired may be equipped with a separate fluid line 220, a separate valve 230, and/or a separate fluid line 220 and valve 230 combination. In some examples of this technology where multiple fluid lines 220 are present, two or more fluid lines may share a common valve 230.

While the above discussion focuses primarily on contact between a game ball or other projectile with the glove(s), glove(s) in accordance with aspects of this technology may be useful during contact with other objects, such as another player or person, the ground or other surface, etc. Alternatively, gloves in accordance with at least some aspects of this technology may be used in "non-sport" related activities and "non-sport" environments and/or uses, such as for work gloves, for casual wear, etc.

Conclusion

The present technology is disclosed above and in the accompanying drawings with reference to a variety of embodiments. The purpose served by the disclosure, however, is to provide an example of the various features and concepts related to this technology, not to limit the scope of the claimed invention. One skilled in the relevant art will recognize that numerous variations and modifications may be made to the embodiments described above without departing from the scope of the presently claimed invention, as defined by the appended claims.

For the avoidance of doubt, the present application includes at least the subject matter described in the following numbered Clauses:

Clause 1. A glove, comprising:

a glove base member; and a bladder engaged with the glove base member, the bladder including:

(A) a thermoplastic envelope defining an interior chamber that is movable between an expanded configuration and a compressed configuration, wherein a first through hole opening is defined through the thermoplastic envelope, the first through hole opening permitting fluid from an external environmental area to enter the interior chamber;

(B) a first fluid line in fluid communication with the interior chamber and with the external environmental area, wherein the first fluid line is separate from the first through hole opening;

(C) a first valve located and configured with respect to the first fluid line to allow fluid to exit the interior chamber via the first fluid line but inhibiting fluid from the external environmental area from entering the interior chamber via the first fluid line; and (D) a resilient component located in the interior chamber, the resilient component applying a force to the thermoplastic envelope in a direction toward the expanded configuration.

Clause 2. The glove according to Clause 1, wherein the first through hole opening is one of a plurality of through hole openings defined through the thermoplastic envelope, the plurality of through hole openings permitting fluid from the external environmental area to enter the interior chamber.

Clause 3. The glove according to Clause 2, wherein the resilient component is configured to change between an expanded state and a compressed state within the interior chamber.

Clause 4. The glove according to Clause 3, wherein a sufficient external force applied to the thermoplastic envelope causes: (a) fluid within the interior chamber to exit the interior chamber through the first fluid line and the first valve and (b) a change in the resilient component from the expanded state to the compressed state.

Clause 5. The glove according to Clause 4, wherein the plurality of through hole openings are sized such that when the resilient component has changed to the compressed state, fluid from the external environmental area is permitted to enter the interior chamber through the plurality of through hole openings at an overall fluid entry rate that delays re-expansion of the resilient component to the expanded state.

Clause 6. The glove according to any one of Clauses 2 to 5, wherein each of the plurality of through hole openings defines a length direction extending through one of thermoplastic envelope and a width direction extending across the respective through hole opening, and wherein each of the plurality of through hole openings has a width dimension across the width direction of less than 2 mm.

Clause 7. The glove according to any one of Clauses 1 to 6, wherein the resilient component includes at least one member selected from the group consisting of: an open cell foam material; a closed cell foam material; a rubber material; an elastomeric material; a resilient plastic material; and a spring.

Clause 8. The glove according to any one of Clauses 1 to 7, wherein the first through hole opening is sized such that when the resilient component is in a compressed state, fluid from the external environmental area is permitted to enter the interior chamber through the first through hole opening at a fluid entry rate that delays expansion of the resilient component to an expanded state.

Clause 9. A glove, comprising:

a glove base member; and a bladder engaged with the glove base member, the bladder including:

(A) a first thermoplastic layer fixed to a second thermoplastic layer at a seam, wherein an interior chamber is defined between the first thermoplastic layer and the second thermoplastic layer and inside the seam, and wherein a first through hole opening is defined through the first thermoplastic layer, the first through hole opening permitting fluid from an external environmental area to enter the interior chamber;

(B) a first fluid line in fluid communication with the interior chamber and with the external environmental area, wherein the first fluid line is separate from the first through hole opening;

(C) a first valve located and configured with respect to the first fluid line to allow fluid to exit the interior chamber via the first fluid line but inhibiting fluid from the external environmental area from entering the interior chamber via the first fluid line; and (D) a foam material located in the interior chamber.

Clause 10. The glove according to Clause 9, wherein the first through hole opening is one of a plurality of through hole openings defined through at least one of the first thermoplastic layer and the second thermoplastic layer, the plurality of through hole openings permitting fluid from the external environmental area to enter the interior chamber.

Clause 11. The glove according to Clause 10, wherein the foam material is configured to change between an expanded configuration and a compressed configuration within the interior chamber.

Clause 12. The glove according to Clause 11, wherein a sufficient external force applied to the first thermoplastic layer causes: (a) fluid within the interior chamber to exit the interior chamber through the first fluid line and the first valve and (b) a change in the foam material from the expanded configuration to the compressed configuration.

Clause 13. The glove according to Clause 12, wherein the plurality of through hole openings are sized such that when the foam material has changed to the compressed configuration, fluid from the external environmental area is permitted to enter the interior chamber through the plurality of through hole openings at an overall fluid entry rate that delays re-expansion of the foam material to the expanded configuration.

Clause 14. The glove according to any one of Clauses 10 to 13, wherein each of the plurality of through hole openings defines a length direction extending through one of the first thermoplastic layer or the second thermoplastic layer and a width direction extending across the respective through hole opening, and wherein each of the plurality of through hole openings has a width dimension across the width direction of less than 2 mm.

Clause 15. The glove according to any one of Clauses 9 to 14, wherein the seam comprises a continuous perimeter seam that extends around an entire exterior perimeter of the bladder except at a single location where the first fluid line interrupts the seam.

Clause 16. The glove according to any one of Clauses 9 to 15, wherein the foam material is configured to change between an expanded configuration and a compressed configuration within the interior chamber, wherein the interior chamber defines a first volume V1, wherein in the expanded configuration the foam material defines a second volume V2, and wherein V2 is at least 60% of V1.

Clause 17. The glove according to any one of Clauses 9 to 15, wherein the foam material is configured to change between an expanded configuration and a compressed configuration within the interior chamber, wherein the interior chamber defines a first volume V1, wherein in the expanded configuration the foam material defines a second volume V2, and wherein V2 is at least 60% of V1 and less than 95% of V1.

Clause 18. The glove according to any one of Clauses 9 to 17, wherein the first through hole opening defines a length direction extending through the first thermoplastic layer and a width direction extending across the first through hole opening, and wherein the first through hole opening has a width dimension across the width direction of less than 2 mm.

Clause 19. The glove according to any one of Clauses 9 to 18, wherein the first through hole opening is sized such that when the foam material is in a compressed configuration, fluid from the external environmental area is permitted to enter the interior chamber through the first through hole opening at a fluid entry rate that delays expansion of the foam material to an expanded configuration.

Clause 20. The glove according to any one of Clauses 1 to 19, wherein the glove base member includes a palm portion configured to cover at least a portion of a wearer's palm when inserted into the glove, and wherein the bladder is engaged with the palm portion.

Clause 21. The glove according to Clause 20, wherein the bladder includes a thumb chamber portion and a first finger chamber portion.

Clause 22. The glove according to Clause 21, wherein the first finger chamber portion is an index finger chamber portion.

Clause 23. The glove according to Clause 20, wherein the bladder includes a thumb chamber portion and two or more separated finger chamber portions.

Clause 24. The glove according to Clause 20, wherein the bladder includes a thumb chamber portion and four separated finger chamber portions.

Clause 25. The glove according to Clause 20, wherein the bladder includes a palm chamber portion, a thumb chamber portion extending away from the palm chamber portion, and a first finger chamber portion extending away from the palm chamber portion.

Clause 26. The glove according to Clause 25, wherein the bladder further includes a second finger chamber portion extending away from the palm chamber portion.

Clause 27. The glove according to Clause 26, wherein the bladder further includes a third finger chamber portion extending away from the palm chamber portion.

Clause 28. The glove according to Clause 27, wherein the bladder further includes a fourth finger chamber portion extending away from the palm chamber portion.

Clause 29. The glove according to any one of Clauses 21 to 28, wherein the thumb chamber portion includes a first thumb chamber lobe, a second thumb chamber lobe, and a first thumb fluid passageway connecting the first thumb chamber lobe and the second thumb chamber lobe.

Clause 30. The glove according to Clause 29, wherein the first thumb fluid passageway comprises a narrowing of the interior chamber of the bladder located to provide a thumb flexion region.

Clause 31. The glove according to Clause 29 or 30, wherein the first thumb chamber lobe is connected with a palm chamber portion of the bladder by a second thumb fluid passageway that comprises a narrowing of the interior chamber of the bladder.

Clause 32. The glove according to any one of Clauses 25 to 31, wherein the palm chamber portion includes a multi-lobe chamber construction.

Clause 33. The glove according to Clause 32, wherein the multi-lobe chamber construction includes two or more palm bladder chamber lobes in fluid communication with one another via one or more fluid passageways.

Clause 34. The glove according to any one of Clauses 25 to 33, wherein the first fluid line opens into the palm chamber portion.

Clause 35. The glove according to any one of Clauses 1 to 19, wherein the bladder includes at least one finger chamber portion.

Clause 36. The glove according to Clause 35, wherein one or more of said at least one finger chamber portion includes a first finger chamber lobe, a second finger chamber lobe, and a first finger fluid passageway connecting the first finger chamber lobe and the second finger chamber lobe.

Clause 37. The glove according to Clause 36, wherein the first finger fluid passageway comprises a narrowing of the interior chamber of the bladder located to provide a finger flexion region.

Clause 38. The glove according to Clause 36 or 37, wherein the first finger chamber lobe is connected with a palm chamber portion of the bladder by a second finger fluid passageway that comprises a narrowing of the interior chamber of the bladder.

Clause 39. The glove according to Clause 35, wherein each of said at least one finger chamber portion includes a first finger chamber lobe, a second finger chamber lobe, and a first finger fluid passageway connecting the first finger chamber lobe and the second finger chamber lobe.

Clause 40. The glove according to Clause 39, wherein for each finger chamber portion, the first finger fluid passageway comprises a narrowing of the interior chamber of the bladder located to provide a finger flexion region.

Clause 41. The glove according to Clause 39 or 40, wherein for each finger chamber portion, the first finger chamber lobe is connected with a palm chamber portion of the bladder by a second finger fluid passageway that comprises a narrowing of the interior chamber of the bladder.

Clause 42. The glove according to any one of Clauses 1 to 41, wherein the glove base member includes a back portion configured to cover at least a portion of a back side of a wearer's hand when inserted into the glove, and wherein a second bladder is engaged with the back portion.

Clause 43. The glove according to any one of Clauses 1 to 19, wherein the glove base member includes a back portion configured to cover at least a portion of a back side of a wearer's hand when inserted into the glove, and wherein the bladder is engaged with the back portion.

Clause 44. The glove according to Clause 43, wherein the bladder includes a fluid-filled chamber portion extending along a knuckle covering portion of the glove base member.

Clause 45. The glove according to Clause 43, wherein the bladder includes a base chamber region and a first finger chamber portion extending away from the base chamber region.

Clause 46. The glove according to Clause 45, wherein a first finger fluid passageway connects the base chamber region and the first finger chamber portion.

Clause 47. The glove according to Clause 45, wherein the bladder further includes a second finger chamber portion extending away from the base chamber region.

Clause 48. The glove according to Clause 47, wherein a first finger fluid passageway connects the base chamber region and the first finger chamber portion and a second finger fluid passageway connects the base chamber region and the second finger chamber portion.

Clause 49. The glove according to Clause 47, wherein the bladder further includes a third finger chamber portion extending away from the base chamber region.

Clause 50. The glove according to Clause 49, wherein a first finger fluid passageway connects the base chamber region and the first finger chamber portion, a second finger fluid passageway connects the base chamber region and the second finger chamber portion, and a third finger fluid passageway connects the base chamber region and the third finger chamber portion.

Clause 51. The glove according to Clause 49, wherein the bladder further includes a fourth finger chamber portion extending away from the base chamber region.

Clause 52. The glove according to Clause 51, wherein a first finger fluid passageway connects the base chamber region and the first finger chamber portion, a second finger fluid passageway connects the base chamber region and the second finger chamber portion, a third finger fluid passageway connects the base chamber region and the third finger chamber portion, and a fourth finger fluid passageway connects the base chamber region and the fourth finger chamber portion.

Clause 53. The glove according to any one of Clauses 45 to 52, wherein the first fluid line opens into the base chamber region.

Clause 54. The glove according to any one of Clauses 1 to 19 or 43 to 53, wherein the glove base member includes a palm portion configured to cover at least a portion of a palm of a wearer's hand when inserted into the glove, and wherein a second bladder is engaged with the palm portion.

Clause 55. The glove according to any one of Clauses 1 to 54, wherein the glove is a sports glove.

Clause 56. The glove according to any one of Clauses 1 to 54, wherein the glove is a goalie glove.

Clause 57. A method of making a glove according to any one of Clauses 1 to 56, comprising: engaging the bladder to the glove base member.

Clause 58. The method according to Clause 57, wherein the engaging includes fixing the bladder to the glove base member by one or more of: an adhesive; one or more mechanical fasteners; or at least one sewn seam; or releasably attaching the bladder to the glove base member.

Clause 59. A method of interacting with a game projectile, comprising:

contacting a game projectile with a glove, wherein the game projectile contacts the glove at a location to apply incident force to a surface of a bladder included with a glove, wherein the bladder includes: (a) an interior chamber defined by a chamber wall, wherein a first through hole opening is defined through the chamber wall, (b) a first fluid line in fluid communication with the interior chamber and with an external environmental area, wherein the first fluid line is separate from the first through hole opening, (c) a first valve located and configured with respect to the first fluid line to allow fluid to exit the interior chamber via the first fluid line but inhibiting fluid from the external environmental area from entering the interior chamber via the first fluid line, and (d) a foam material located in the interior chamber, wherein the contacting causes: (i) the foam material to change from an expanded configuration to a compressed configuration and (ii) fluid to exit the interior chamber through the first fluid line and the first valve; and admitting fluid into the interior chamber through the first through hole opening, wherein the first through hole opening is sized to delay expansion of the foam material to the expanded configuration.

Clause 60. A method of interacting with a game projectile, comprising:

contacting a game projectile with a glove, wherein the game projectile contacts the glove at a location to apply incident force to a surface of a bladder included with a glove, wherein the bladder includes: (a) an interior chamber defined by a chamber wall, wherein a plurality of through hole openings are defined through the chamber wall, (b) a first fluid line in fluid communication with the interior chamber and with an external environmental area, wherein the first fluid line is separate from the plurality of through hole openings, (c) a first valve located and configured with respect to the first fluid line to allow fluid to exit the interior chamber via the first fluid line but inhibiting fluid from the external environmental area from entering the interior chamber via the first fluid line, and (d) a foam material located in the interior chamber, wherein the contacting causes: (i) the foam material to change from an expanded configuration to a compressed configuration and (ii) fluid to exit the interior chamber through the first fluid line and the first valve; and admitting fluid into the interior chamber through one or more of the plurality of through hole openings, wherein the plurality of through hole openings are sized such that fluid from the external environmental area is admitted into the interior chamber through the one or more of the plurality of through hole openings at an overall fluid entry rate that delays expansion of the foam material to the expanded configuration.

Clause 61. A method of interacting with a game projectile, comprising:

contacting a game projectile with a glove, wherein the game projectile contacts the glove at a location to apply incident force to a surface of a bladder included with a glove, wherein the bladder includes: (a) an interior chamber defined by a chamber wall, wherein a first through hole opening is defined through the chamber wall, (b) a first fluid line in fluid communication with the interior chamber and with an external environmental area, wherein the first fluid line is separate from the first through hole opening, (c) a first valve located and configured with respect to the first fluid line to allow fluid to exit the interior chamber via the first fluid line but inhibiting fluid from the external environmental area from entering the interior chamber via the first fluid line, and (d) a resilient component located in the interior chamber, wherein the contacting causes: (i) the resilient component to change from an expanded state to a compressed state and (ii) fluid to exit the interior chamber through the first fluid line and the first valve; and admitting fluid into the interior chamber through the first through hole opening, wherein the first through hole opening is sized to delay expansion of the resilient component to the expanded state.

Clause 62. A method of interacting with a game projectile, comprising:

contacting a game projectile with a glove, wherein the game projectile contacts the glove at a location to apply incident force to a surface of a bladder included with a glove, wherein the bladder includes: (a) an interior chamber defined by a chamber wall, wherein a plurality of through hole openings are defined through the chamber wall, (b) a first fluid line in fluid communication with the interior chamber and with an external environmental area, wherein the first fluid line is separate from the plurality of through hole openings, (c) a first valve located and configured with respect to the first fluid line to allow fluid to exit the interior chamber via the first fluid line but inhibiting fluid from the external environmental area from entering the interior chamber via the first fluid line, and (d) a resilient component located in the interior chamber, wherein the contacting causes: (i) the resilient component to change from an expanded state to a compressed state and (ii) fluid to exit the interior chamber through the first fluid line and the first valve; and admitting fluid into the interior chamber through one or more of the plurality of through hole openings, wherein the plurality of through hole openings are sized such that fluid from the external environmental area is admitted into the interior chamber through the one or more of the plurality of through hole openings at an overall fluid entry rate that delays expansion of the resilient component to the expanded state.

Clause 63. A bladder, comprising:

a thermoplastic envelope defining an interior chamber that is movable between an expanded configuration and a compressed configuration, wherein one or more through hole openings are defined through the thermoplastic envelope, the one or more through hole openings permitting fluid from an external environmental area to enter the interior chamber, and wherein the interior chamber of the bladder defines a thumb chamber portion and a first finger chamber portion;

a first fluid line in fluid communication with the interior chamber and with the external environmental area, wherein the first fluid line is separate from the one or more through hole openings;

a first valve located and configured with respect to the first fluid line to allow fluid to exit the interior chamber via the first fluid line but inhibiting fluid from the external environmental area from entering the interior chamber via the first fluid line; and a resilient component located in the interior chamber, the resilient component applying a force to the thermoplastic envelope in a direction toward the expanded configuration.

Clause 64. A bladder, comprising:

a first thermoplastic layer fixed to a second thermoplastic layer at a seam, wherein an interior chamber is defined between the first thermoplastic layer and the second thermoplastic layer and inside the seam, wherein one or more through hole openings are defined through the first thermoplastic layer and/or the second thermoplastic layer, the one or more through hole openings permitting fluid from an external environmental area to enter the interior chamber, and wherein the interior chamber of the bladder defines a thumb chamber portion and a first finger chamber portion;

a first fluid line in fluid communication with the interior chamber and with the external environmental area, wherein the first fluid line is separate from the one or more through hole openings;

a first valve located and configured with respect to the first fluid line to allow fluid to exit the interior chamber via the first fluid line but inhibiting fluid from the external environmental area from entering the interior chamber via the first fluid line; and a foam material located in the interior chamber.

Clause 65. The bladder according to Clause 63 or 64, wherein the first finger chamber portion is an index finger chamber portion.

Clause 66. The bladder according to Clause 63 or 64, wherein the interior chamber of the bladder defines at least one additional finger chamber portion separated from the first finger chamber portion.

Clause 67. The bladder according to Clause 63 or 64, wherein the interior chamber of the bladder defines a second finger chamber portion, a third finger chamber portion, and a fourth finger chamber portion, wherein the first finger chamber portion, the second finger chamber portion, the third finger chamber portion, and the fourth finger chamber portion are separated from one another.

Clause 68. The bladder according to Clause 63 or 64, wherein the interior chamber of the bladder further defines a palm chamber portion, wherein the thumb chamber portion and the first finger chamber portion extend from the palm chamber portion.

Clause 69. The bladder according to Clause 68, wherein the interior chamber of the bladder further defines a second finger chamber portion extending from the palm chamber portion.

Clause 70. The bladder according to Clause 69, wherein the second finger chamber portion includes a first finger chamber lobe, a second finger chamber lobe, and a fluid passageway connecting the first finger chamber lobe and the second finger chamber lobe.

Clause 71. The bladder according to Clause 70, wherein the fluid passageway connecting the first finger chamber lobe and the second finger chamber lobe comprises a narrowing of the interior chamber of the bladder located to provide a second finger flexion region.

Clause 72. The bladder according to Clause 70 or 71, wherein the first finger chamber lobe is connected with the palm chamber portion of the bladder by a fluid passageway that comprises a narrowing of the interior chamber of the bladder.

Clause 73. The bladder according to any one of Clauses 69 to 70, wherein the interior chamber of the bladder further defines a third finger chamber portion extending from the palm chamber portion.

Clause 74. The bladder according to Clause 73, wherein the third finger chamber portion includes a third finger chamber lobe, a fourth finger chamber lobe, and a fluid passageway connecting the third finger chamber lobe and the fourth finger chamber lobe.

Clause 75. The bladder according to Clause 74, wherein the fluid passageway connecting the third finger chamber lobe and the fourth finger chamber lobe comprises a narrowing of the interior chamber of the bladder located to provide a third finger flexion region.

Clause 76. The bladder according to Clause 74 or 75, wherein the third finger chamber lobe is connected with the palm chamber portion of the bladder by a fluid passageway that comprises a narrowing of the interior chamber of the bladder.

Clause 77. The bladder according to Clauses 73 to 76, wherein the interior chamber of the bladder further defines a fourth finger chamber portion extending from the palm chamber portion.

Clause 78. The bladder according to Clause 77, wherein the fourth finger chamber portion includes a fifth finger chamber lobe, a sixth finger chamber lobe, and a fluid passageway connecting the fifth finger chamber lobe and the sixth finger chamber lobe.

Clause 79. The bladder according to Clause 78, wherein the fluid passageway connecting the fifth finger chamber lobe and the sixth finger chamber lobe comprises a narrowing of the interior chamber of the bladder located to provide a fourth finger flexion region.

Clause 80. The bladder according to Clause 78 or 79, wherein the fifth finger chamber lobe is connected with the palm chamber portion of the bladder by a fluid passageway that comprises a narrowing of the interior chamber of the bladder.

Clause 81. The bladder according to any one of Clauses 68 to 80, wherein the palm chamber portion includes a multi-lobe chamber construction.

Clause 82. The bladder according to Clause 81, wherein the multi-lobe chamber construction includes two or more palm bladder chamber lobes in fluid communication with one another via one or more fluid passageways.

Clause 83. The bladder according to any one of Clauses 68 to 82, wherein the first fluid line opens into the palm chamber portion.

Clause 84. The bladder according to Clauses 63 to 83, wherein the first finger chamber portion includes a first finger chamber lobe, a second finger chamber lobe, and a first finger fluid passageway connecting the first finger chamber lobe and the second finger chamber lobe.

Clause 85. The bladder according to Clause 84, wherein the first finger fluid passageway comprises a narrowing of the interior chamber of the bladder located to provide a first finger flexion region.

Clause 86. The bladder according to Clause 84 or 85, wherein the first finger chamber lobe is connected with a palm chamber portion of the bladder by a second finger fluid passageway that comprises a narrowing of the interior chamber of the bladder.

Clause 87. The bladder according to any one of Clauses 63 to 86, wherein the thumb chamber portion includes a first thumb chamber lobe, a second thumb chamber lobe, and a first thumb fluid passageway connecting the first thumb chamber lobe and the second thumb chamber lobe.

Clause 88. The bladder according to Clause 87, wherein the first thumb fluid passageway comprises a narrowing of the interior chamber of the bladder located to provide a thumb flexion region.

Clause 89. The bladder according to Clause 87 or 88, wherein the first thumb chamber lobe is connected with a palm chamber portion of the bladder by a second thumb fluid passageway that comprises a narrowing of the interior chamber of the bladder.

Clause 90. A bladder, comprising:

a thermoplastic envelope defining an interior chamber that is movable between an expanded configuration and a compressed configuration, wherein one or more through hole openings are defined through the thermoplastic envelope, the one or more through hole openings permitting fluid from an external environmental area to enter the interior chamber, and wherein the interior chamber of the bladder defines a base chamber region and a first finger chamber portion extending from the base chamber region;

a first fluid line in fluid communication with the interior chamber and with the external environmental area, wherein the first fluid line is separate from the one or more through hole openings;

a first valve located and configured with respect to the first fluid line to allow fluid to exit the interior chamber via the first fluid line but inhibiting fluid from the external environmental area from entering the interior chamber via the first fluid line; and a resilient component located in the interior chamber, the resilient component applying a force to the thermoplastic envelope in a direction toward the expanded configuration.

Clause 91. A bladder, comprising:

a first thermoplastic layer fixed to a second thermoplastic layer at a seam, wherein an interior chamber is defined between the first thermoplastic layer and the second thermoplastic layer and inside the seam, wherein one or more through hole openings are defined through the first thermoplastic layer and/or the second thermoplastic layer, the one or more through hole openings permitting fluid from an external environmental area to enter the interior chamber, and wherein the interior chamber of the bladder defines a base chamber region and a first finger chamber portion extending from the base chamber region;

a first fluid line in fluid communication with the interior chamber and with the external environmental area, wherein the first fluid line is separate from the one or more through hole openings;

a first valve located and configured with respect to the first fluid line to allow fluid to exit the interior chamber via the first fluid line but inhibiting fluid from the external environmental area from entering the interior chamber via the first fluid line; and a foam material located in the interior chamber.

Clause 92. The bladder according to Clause 90 or 91, wherein a first finger fluid passageway connects the base chamber region and the first finger chamber portion.

Clause 93. The bladder according to Clause 90 or 91, wherein the interior chamber of the bladder further defines a second finger chamber portion extending from the base chamber region.

Clause 94. The bladder according to Clause 93, wherein a first finger fluid passageway connects the base chamber region and the first finger chamber portion and a second finger fluid passageway connects the base chamber region and the second finger chamber portion.

Clause 95. The bladder according to Clause 94, wherein the first finger fluid passageway comprises a first narrowing of the interior chamber of the bladder located to provide a first flexion region, and wherein the second finger fluid passageway comprises a second narrowing of the interior chamber of the bladder located to provide a second flexion region.

Clause 96. The bladder according to Clause 93, wherein the interior chamber of the bladder further defines a third finger chamber portion extending from the base chamber region.

Clause 97. The bladder according to Clause 96, wherein a first finger fluid passageway connects the base chamber region and the first finger chamber portion, a second finger fluid passageway connects the base chamber region and the second finger chamber portion, and a third finger fluid passageway connects the base chamber region and the third finger chamber portion.

Clause 98. The bladder according to Clause 97, wherein the first finger fluid passageway comprises a first narrowing of the interior chamber of the bladder located to provide a first flexion region, wherein the second finger fluid passageway comprises a second narrowing of the interior chamber of the bladder located to provide a second flexion region, and wherein the third finger fluid passageway comprises a third narrowing of the interior chamber of the bladder located to provide a third flexion region.

Clause 99. The bladder according to Clause 96, wherein the interior chamber of the bladder further defines a fourth finger chamber portion extending away from the base chamber region.

Clause 100. The bladder according to Clause 99, wherein a first finger fluid passageway connects the base chamber region and the first finger chamber portion, a second finger fluid passageway connects the base chamber region and the second finger chamber portion, a third finger fluid passageway connects the base chamber region and the third finger chamber portion, and a fourth finger fluid passageway connects the base chamber region and the fourth finger chamber portion.

Clause 101. The bladder according to Clause 100, wherein the first finger fluid passageway comprises a first narrowing of the interior chamber of the bladder located to provide a first flexion region, wherein the second finger fluid passageway comprises a second narrowing of the interior chamber of the bladder located to provide a second flexion region, wherein the third finger fluid passageway comprises a third narrowing of the interior chamber of the bladder located to provide a third flexion region, and wherein the fourth finger fluid passageway comprises a fourth narrowing of the interior chamber of the bladder located to provide a fourth flexion region.

Clause 102. The bladder according to any one of Clauses 63 to 101, wherein the first fluid line opens into the base chamber region.

Clause 103. A glove, comprising: (A) a glove base member; and (B) a bladder according to any one of Clauses 63 to 102 engaged with the glove base member.

What is claimed is:

1. A glove, comprising:

a glove base member; and a bladder engaged with the glove base member, the bladder including:

(A) a thermoplastic envelope including two opposed interior surfaces and defining an interior chamber that is movable between an expanded configuration and a compressed configuration, wherein a first through hole opening is defined through the thermoplastic envelope, the first through hole opening being configured to permit fluid from an external environmental area to enter the interior chamber as the interior chamber transitions from the compressed configuration to the expanded configuration;

(B) a first fluid line in fluid communication with the interior chamber and with the external environmental area, wherein the first fluid line is separate from the first through hole opening;

(C) a first one-way valve located and configured with respect to the first fluid line: (a) to allow fluid to exit the interior chamber via the first fluid line in response to an external force incident on the bladder thereby causing the interior chamber to transition from the expanded configuration to the compressed configuration, but (b) to inhibit fluid from the external environmental area from entering the interior chamber via the first fluid line; and (D) a resilient component located in the interior chamber, the resilient component being configured to: (a) apply force to the two opposed interior surfaces of the thermoplastic envelope in a direction toward the expanded configuration, and (b) move the two opposed interior surfaces away from one another as the interior chamber transitions from the compressed configuration to the expanded configuration as fluid from the external environmental area enters the interior chamber via the first through hole opening.

2. The glove according to claim 1, wherein the first through hole opening is one of a plurality of through hole openings defined through the thermoplastic envelope, the plurality of through hole openings permitting fluid from the external environmental area to enter the interior chamber.

3. The glove according to claim 2, wherein when the external force causes the interior chamber to transition from the expanded configuration to the compressed configuration, the resilient component is configured to change between an expanded state and a compressed state within the interior chamber.

4. The glove according to claim 3, wherein the plurality of through hole openings are sized such that when the resilient component has changed to the compressed state, fluid from the external environmental area is permitted to enter the interior chamber through the plurality of through hole openings at an overall fluid entry rate that delays re-expansion of the resilient component to the expanded state.

5. The glove according to claim 1, wherein the resilient component includes at least one member selected from the group consisting of: an open cell foam material; a closed cell foam material; a rubber material; an elastomeric material; a resilient plastic material; and a spring.

6. A glove, comprising:

a glove base member; and a bladder engaged with the glove base member, the bladder including:

(A) a first thermoplastic layer fixed to a second thermoplastic layer at a seam, wherein an interior chamber is defined between the first thermoplastic layer and the second thermoplastic layer and inside the seam, the interior chamber being movable between an expanded configuration and a compressed configuration, and wherein a first through hole opening is defined through the first thermoplastic layer, the first through hole opening being configured to permit fluid from an external environmental area to enter the interior chamber as the interior chamber transitions from the compressed configuration to the expanded configuration;

(B) a first fluid line in fluid communication with the interior chamber and with the external environmental area, wherein the first fluid line is separate from the first through hole opening;

(C) a first one-way valve located and configured with respect to the first fluid line: (a) to allow fluid to exit the interior chamber via the first fluid line in response to an external force incident on the bladder thereby causing the interior chamber to transition from the expanded configuration to the compressed configuration, but (b) to inhibit fluid from the external environmental area from entering the interior chamber via the first fluid line; and (D) a foam material located in the interior chamber, the foam material being configured to: (a) apply force to the first thermoplastic layer and the second thermoplastic layer in a direction toward the expanded configuration, and (b) move the first thermoplastic layer and the second thermoplastic layer away from one another as the interior chamber transitions from the compressed configuration to the expanded configuration as fluid from the external environmental area enters the interior chamber via the first through hole opening.

7. The glove according to claim 6, wherein the first through hole opening is one of a plurality of through hole openings defined through at least one of the first thermoplastic layer and the second thermoplastic layer, the plurality of through hole openings configured to permit fluid from the external environmental area to enter the interior chamber.

8. The glove according to claim 7, wherein when the external force causes the interior chamber to transition from the expanded configuration to the compressed configuration, the foam material is configured to change between an expanded state and a compressed state within the interior chamber.

9. The glove according to claim 8, wherein the plurality of through hole openings are sized such that when the foam material has changed to the compressed state, fluid from the external environmental area is permitted to enter the interior chamber through the plurality of through hole openings at an overall fluid entry rate that delays re-expansion of the foam material to the expanded configuration.

10. The glove according to claim 7, wherein each of the plurality of through hole openings defines a length direction extending through one of the first thermoplastic layer or the second thermoplastic layer and a width direction extending across the respective through hole opening, and wherein each of the plurality of through hole openings has a width dimension across the width direction of less than 2 mm.

11. The glove according to claim 6, wherein the seam comprises a continuous perimeter seam that extends around an entire exterior perimeter of the bladder except at a single location where the first fluid line interrupts the seam.

12. The glove according to claim 6, wherein the first through hole opening is sized such that when the foam material is in a compressed state, fluid from the external environmental area is permitted to enter the interior chamber through the first through hole opening at a fluid entry rate that delays expansion of the foam material to an expanded state.

13. The glove according to claim 6, wherein the glove base member includes a palm portion configured to cover at least a portion of a wearer's palm when inserted into the glove, and wherein the bladder is engaged with the palm portion.

14. The glove according to claim 13, wherein the bladder includes a thumb chamber portion and a first finger chamber portion.

15. The glove according to claim 14, wherein the first finger chamber portion is an index finger chamber portion.

16. The glove according to claim 13, wherein the bladder includes a thumb chamber portion and four separated finger chamber portions.

17. The glove according to claim 13, wherein the bladder includes a palm chamber portion, a thumb chamber portion extending away from the palm chamber portion, and a first finger chamber portion extending away from the palm chamber portion.

18. The glove according to claim 17, wherein the bladder further includes a second finger chamber portion extending away from the palm chamber portion, a third finger chamber portion extending away from the palm chamber portion, and a fourth finger chamber portion extending away from the palm chamber portion.

19. The glove according to claim 17, wherein the first fluid line opens into the palm chamber portion.

20. The glove according to claim 6, wherein the glove base member includes a back portion configured to cover at least a portion of a back side of a wearer's hand when inserted into the glove, and wherein the bladder is engaged with the back portion.

* * * * *